US006275999B1

(12) United States Patent
Fujita

(10) Patent No.: US 6,275,999 B1
(45) Date of Patent: Aug. 21, 2001

(54) HINGE DEVICE FOR SUPPORTING SEAT AND SEAT LID OF TOILET BOWL OPENABLY AND CLOSABLY

(75) Inventor: Oriya Fujita, Kanagawa (JP)

(73) Assignee: Katoh Electrical Machinery Co., Ltd., Kanagawa (JP)

( * ) Notice: Subject to any disclaimer, the term of this patent is extended or adjusted under 35 U.S.C. 154(b) by 0 days.

(21) Appl. No.: 09/302,030

(22) Filed: Apr. 29, 1999

(30) Foreign Application Priority Data

May 1, 1998 (JP) ..... 10-122571
Jun. 16, 1998 (JP) ..... 10-169044

(51) Int. Cl.[7] ..... A47K 13/12
(52) U.S. Cl. ..... 4/236; 4/248
(58) Field of Search ..... 4/236, 240, 246.1, 4/248; 13/303

(56) References Cited

U.S. PATENT DOCUMENTS 5,682,644 * 11/1997 Bohacik et al. ..... 16/303 X
5,970,819 * 10/1999 Katoh ..... 16/303 X
6,052,869 * 4/2000 Suzuki ..... 4/148 X

* cited by examiner

*Primary Examiner*—Robert M. Fetsuga
(74) *Attorney, Agent, or Firm*—Notaro & Michalos P.C.

(57) ABSTRACT

A hinge device for use to support a seat and seat lid of a toilet bowl openably and closably is provided which can also be implemented even without any rubber ring and provide a delicately controlled feeling with the sea and seat lid when being opened or closed. The hinge device comprises a cylindrical hinge case to be fixed to the body of a toilet bowl and having a partition wall formed therein; a rotating shaft provided rotatably inside the hinge case to support a seat and seat lid of the toilet bowl and consisting of a large-diameter portion which is born in the inner wall of the hinge case and a small-diameter portion which is born in a bearing hole formed in the partition wall of the hinge case; a stationary cam provided inside the hinge case, fixed to the partition wall of the hinge case and having the small-diameter portion of the rotating shaft penetrated through the central portion thereof; a rotatable sliding cam provided inside the hinge case opposite the stationary cam to be slidable axially and rotatable along with the small-diameter portion of the rotating shaft penetrated through the central portion thereof; an elastic means wound on the outer surface of the rotating shaft and between the rotatable sliding cam and the large-diameter portion of the rotating shaft; and means for adjusting the elasticity of the elastic means.

1 Claim, 26 Drawing Sheets

HINGE DEVICE FOR SUPPORTING SEAT AND SEAT LID OF TOILET BOWL OPENABLY AND CLOSABLY

BACKGROUND OF THE INVENTION

1. Field of the Invention

The present invention relates to a hinge, and more particularly to a hinge device suitable for use to support a seat and seat lid of a toilet bowl openably and closably.

2. Description of the Prior Art

Various types of hinge devices have so far been proposed for supporting a toilet bowl seat and seat lid openably and closably. Typical ones of such hinge devices include a combination of a rotating shaft to support the seat and seat lid of the toilet bowl and a cam mechanism provided with a compression spring which acts on the shaft, a combination of a rotating shaft and a torsion spring which acts in a direction of canceling a torque of the rotating shaft being rotated in a predetermined direction, a combination of a rotating shaft and a hydraulic damper which acts on the rotating shaft, or a similar combination.

The conventional hinge device of the type in which only the cam mechanism is allowed to act on the rotating shaft is advantageous in that a matching can easily be attained between a torque generated when the seat and/or lid are operated and a rotation moment of the seat and lid. For a large torque, however, the hinge device should have a large structure.

The conventional hinge device in which only the torsion spring acts on the rotating shaft has an advantageous in that even a small structure of the hinge deice can create a large torque. Since the torque increases and decreases linearly as the seat and/or seat lid are operated, however, no easy matching is attainable between the torque of the seat and the seat lid and a sine curve depicted by the rotation moment of the seat and lid being operated, so that it is difficult to elaborately fit the torque of the seat and seat lid to a curve delineated by the rotation moment of them when being operated and also to provide a appropriately accented operation of the seat and lid being operated.

Further, the conventional hinge device in which only the hydraulic damper is used to act on the rotating shaft is not advantageous in the difficulty of elaborately fitting the torque of the seat and seat lid to a curve depicted by the rotation moment of them and also of providing an appropriately accented motion of the seat and lid being opened or closed, for example, stopping and holding the seat at an intermediate angular position, and braking the seat having been opened to a predetermined angular position.

To control the rotation moment of the openable/closable body such as a seat and seat lid of a toilet bowl in order to softly close the openable/closable body, the Inventor of the present invention proposed a hinge device for use to support the seat and seat lid of the toilet bowl openably and closably, comprising a hinge case, a rotating shaft rotatably provided inside the hinge case, a stationary cam having the rotating shaft penetrated through the center thereof and fixed inside the hinge shaft, a rotatable sliding cam having the rotating shaft penetrated through the central portion thereof to be slidable axially and rotatable with the rotating shaft, and an elastic means for urging the rotatable sliding cam towards the stationary cam, the hinge device comprising a damping means consisting of a rubber ring fitted on the rotating shaft and between the rotating shaft and hinge case and a viscous oil applied between the rubber ring and hinge case, the damping means being allowed to act on the rotating shaft.

In this hinge device, a pressure under which the rubber ring is urged to the inner wall of the hinge case can be adjusted to control the torque of the rotating shaft. However, this hinge device is disadvantageous in that it is only applicable to a hinge device in which such a rubber ring is used.

SUMMARY OF THE INVENTION

Accordingly, the present invention has an object to overcome the above-mentioned drawbacks of the prior art by providing a hinge device for use to support a seat and seat lid of a toilet bowl, implementable even without any rubber ring used, and which can provide a delicately controlled feeling with the motion of the seat and seat lid supported by the hinge device.

The above object can be attained by providing a hinge device for use to support a seat and seat lid of a toilet bowl, comprising a hinge case, a rotating shaft provided rotatably inside the hinge case, a stationary cam having the rotating shaft penetrated through the central portion thereof and fixed to a partition wall provided inside the hinge case, a rotatable sliding cam having the rotating shaft penetrated through the central portion thereof slidably axially and rotatably along with the rotating shaft, an elastic means for urging the rotatable sliding cam towards the stationary cam, and means for adjusting the elasticity of the elastic means.

According to the present invention, the adjusting means may be composed of a plurality of projections formed on an end face of the stationary cam opposite to the rotatable sliding cam, extending through and out of the partition wall of the hinge case in a direction away from the rotatable sliding cam and axially slidable in the partition wall, and an adjusting screw abutting the projections and screwed to the hinge case.

According to the present invention, the adjusting means may be formed from a cap abutting one end of the elastic means and screwed in the hinge case.

The above object can be attained also by providing a hinge device for use to support a seat and seat lid of a toilet bowl, comprising:

- a hinge case;
- a rotating shaft provided rotatably inside the hinge case;
- a rubber ring fitted on the rotating shaft and in forced contact with the inner wall of the hinge case;
- a damping means formed from a viscous oil applied to the outer surface of the rubber ring;
- a rotatable cam provided on the rotating shaft;
- a sliding cam provided slidably inside the hinge case and having formed opposite the rotating shaft in a central portion thereof a hole through which the rotating shaft is penetrated;
- a cap provided at a side of the sliding cam opposite to the rotatable cam and screwed to the hinge case to be movable axially; and
- an elastic means provided inside the hinge case between the cap and sliding cam.

Also, the above object can be attained by providing a hinge device for use to support a seat and seat lid of a toilet bowl, comprising:

- a hinge case;
- a rotating shaft provided rotatably inside the hinge case;
- a stationary sliding cam engaged axially slidably inside the hinge case and having formed in the central portion thereof a hole through which the rotating shaft is penetrated;

a rotatable sliding cam provided inside the hinge case opposite the stationary sliding cam and having the rotating shaft engaged in a hole formed in the center thereof rotatably along with the stationary sliding cam;

an elastic means provided wound on the rotating shaft and between the hinge case and stationary sliding cam;

a damping means provided slidably inside the hinge case and made of a rotation damper having a pivot coupled to a side of the rotatable sliding cam opposite to the stationary sliding cam; and a cap screwed to the hinge case to slide the rotation damper axially of the hinge case.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 10 is a front view of the hinge device in FIG. 9;

FIG. 11 is a partially sectional side elevation of the hinge device in FIG. 9;

FIG. 12 is a left side elevation of the rotating shaft of the hinge device in FIG. 9;

FIG. 13 is a right side elevation of the rotating shaft of the hinge device in FIG. 9;

FIG. 15 explains the installation of the hinge device in FIG. 9;

FIG. 36 is a right side elevation of the rotatable sliding cam included in the hinge device in FIG. 32;

FIG. 37 is a right side elevation of the spring holder included in the hinge device in FIG. 32;

FIG. 38 is a left side elevation of the spring holder in FIG. 36;

DETAILED DESCRIPTION OF THE PREFERRED EMBODIMENTS

The present invention will be described hereinafter concerning an embodiment of the hinge device adapted for use with an openable/closable body such as a seat and seat lid of a toilet bowl. It should be noted, however, that the present invention is not limited to such an embodiment but it is applicable for use with various openable and closable bodies.

Figure 1:
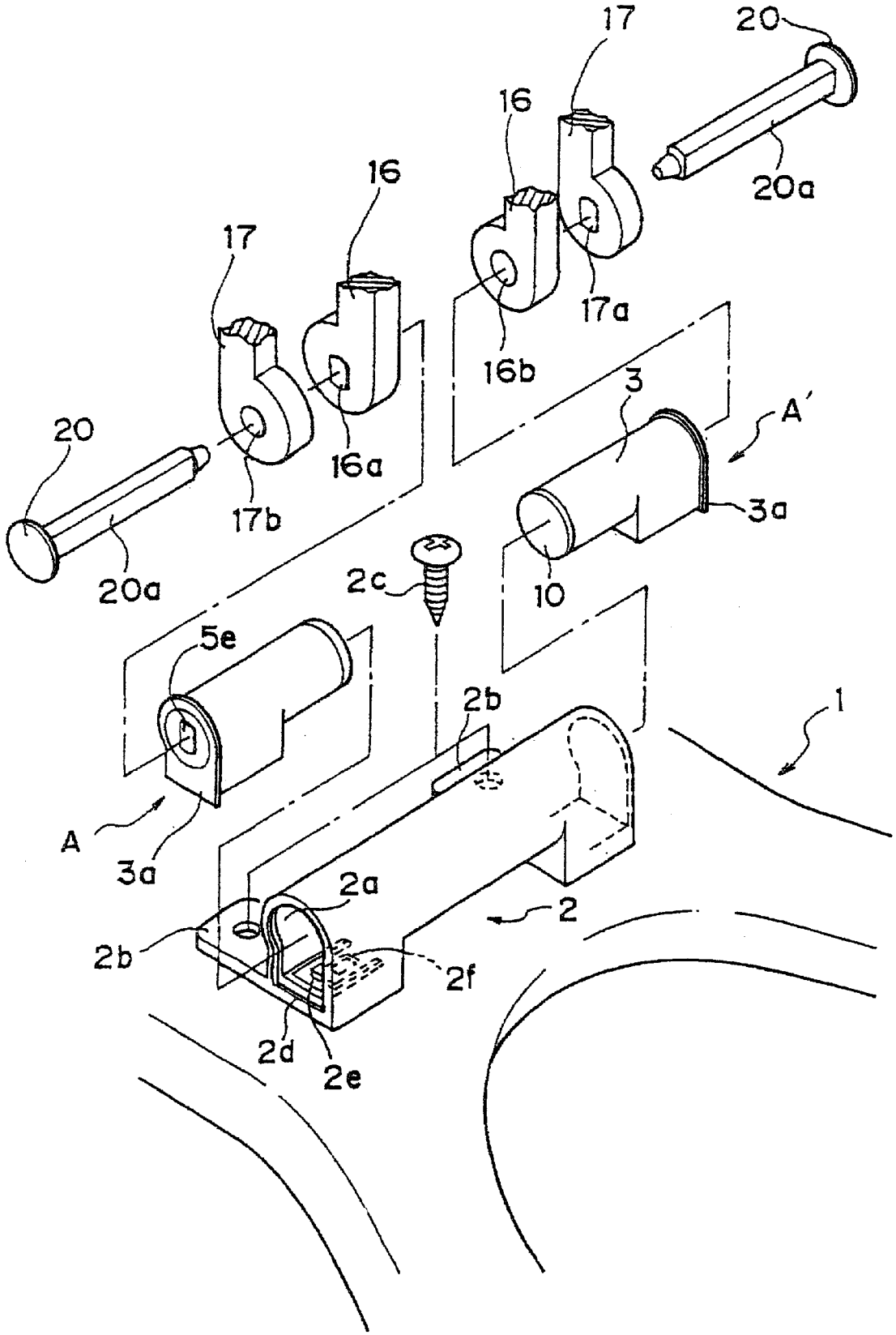
FIG. 1 is an exploded perspective view of an example of holders for use to install a first embodiment of the hinge device according to the present invention to the body of a toilet bowl.

Referring now to FIG. 1, a toilet bowl with which the hinge is to be used is illustrated by way of example, of which the toilet bowl body is generally indicated with a reference numeral 1. For installation of the first embodiment of the hinge device according to the present invention to the toilet bowl body 1, there is provided on, and nearly at the center of, the rear top of the toilet bowl body 1 a cylindrical holder 2 open at either axial end thereof (namely, it has a pair of fixing bores of which only one 2*a* is illustrated herein) and having two rearward projecting plates 2*b* formed integrally with the cylinder 2. The cylinder 2 is to be secured to the toilet bowl body 1 with a pair of two bolts 2*c* (only one of which is illustrated herein) which are to be screwed into the bowl body 1 through a pair of holes formed in the projecting plates 2*b*, respectively. A pair of cylindrical hinge cases 3 is also included in the hinge device according to the present invention and forms a pair of hinge devices generally indicated with references A and A', right and left, respectively. The hinge cases 3 are designed for insertion into the bores 2*a*, respectively, of the cylinder 2, and removably fixed inside the cylinder 2. For this fixation of each hinge case 3 inside the cylinder 2, the hinge case 3 has a non-round flange 3*a* formed integrally at one end thereof, and an engagement projection 3*b* formed integrally on the lower side thereof, as shown in FIGS. 1 to 5. The flange 3*a* is designed to fit in an engagement indent 2*d* formed along the open end, around the bore 2*a*, of the cylinder 2. The projection 3*b* is engaged in a hole 2*f* formed in an engagement piece 2*e* provided on the bottom of the bore 2*a* of the cylinder 2.

As seen in FIG. 1, the right and left hinge devices A and A' form one pair. The left hinge A is destined for use with the toilet seat, while the right one A' is for use with the seat lid. However, it should be noted that since they are horizontally symmetrical with each other and identical in internal structure to each other, mainly the left hinge A will be described below for the simplicity of the explanation.

Figure 2:
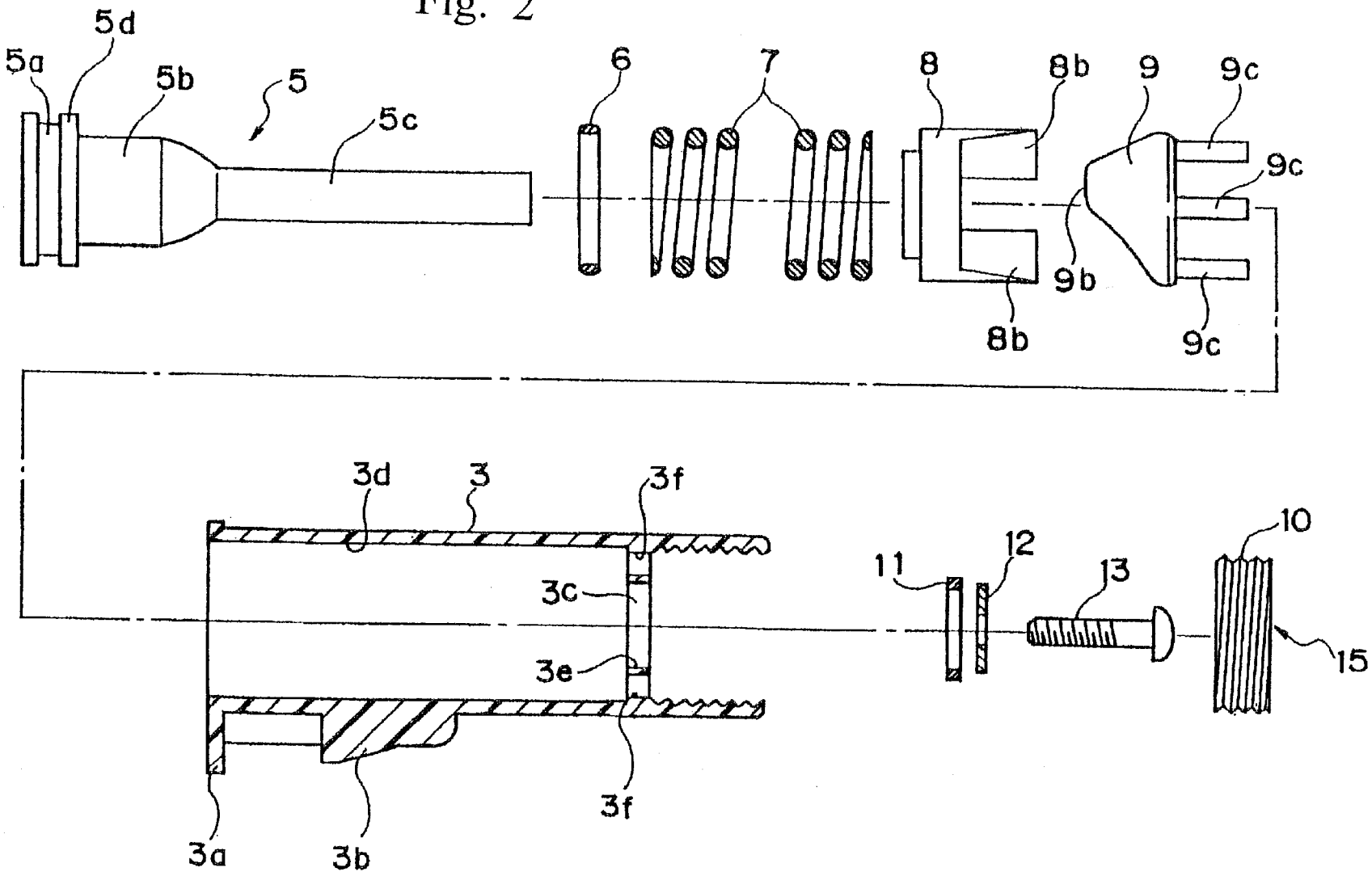
FIG. 2 is a partially axial-sectional exploded front view of the hinge device included in the present invention.
Figure 3:
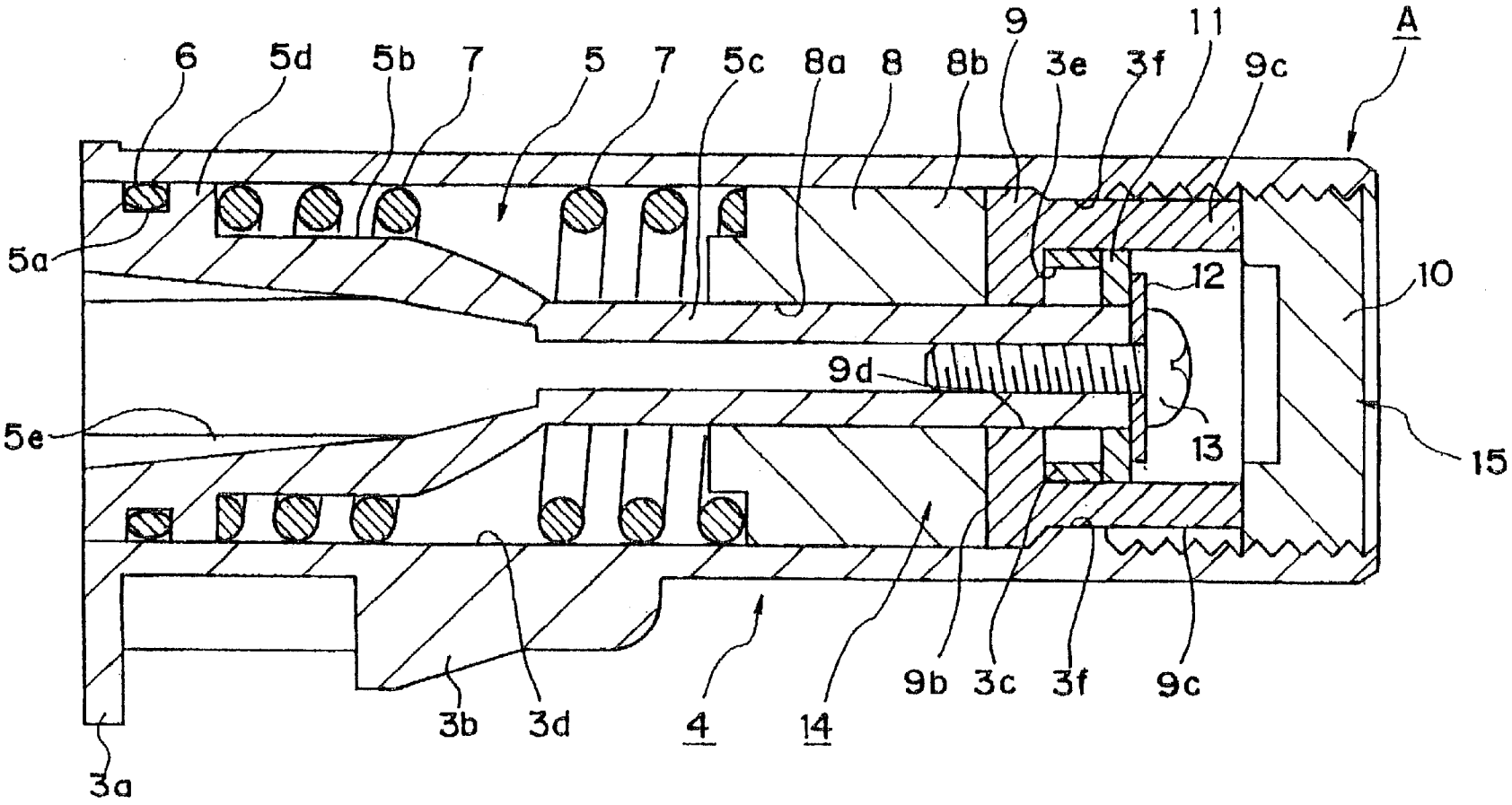
FIG. 3 is an axial-sectional front view of the hinge device of the present invention.
Figure 4:
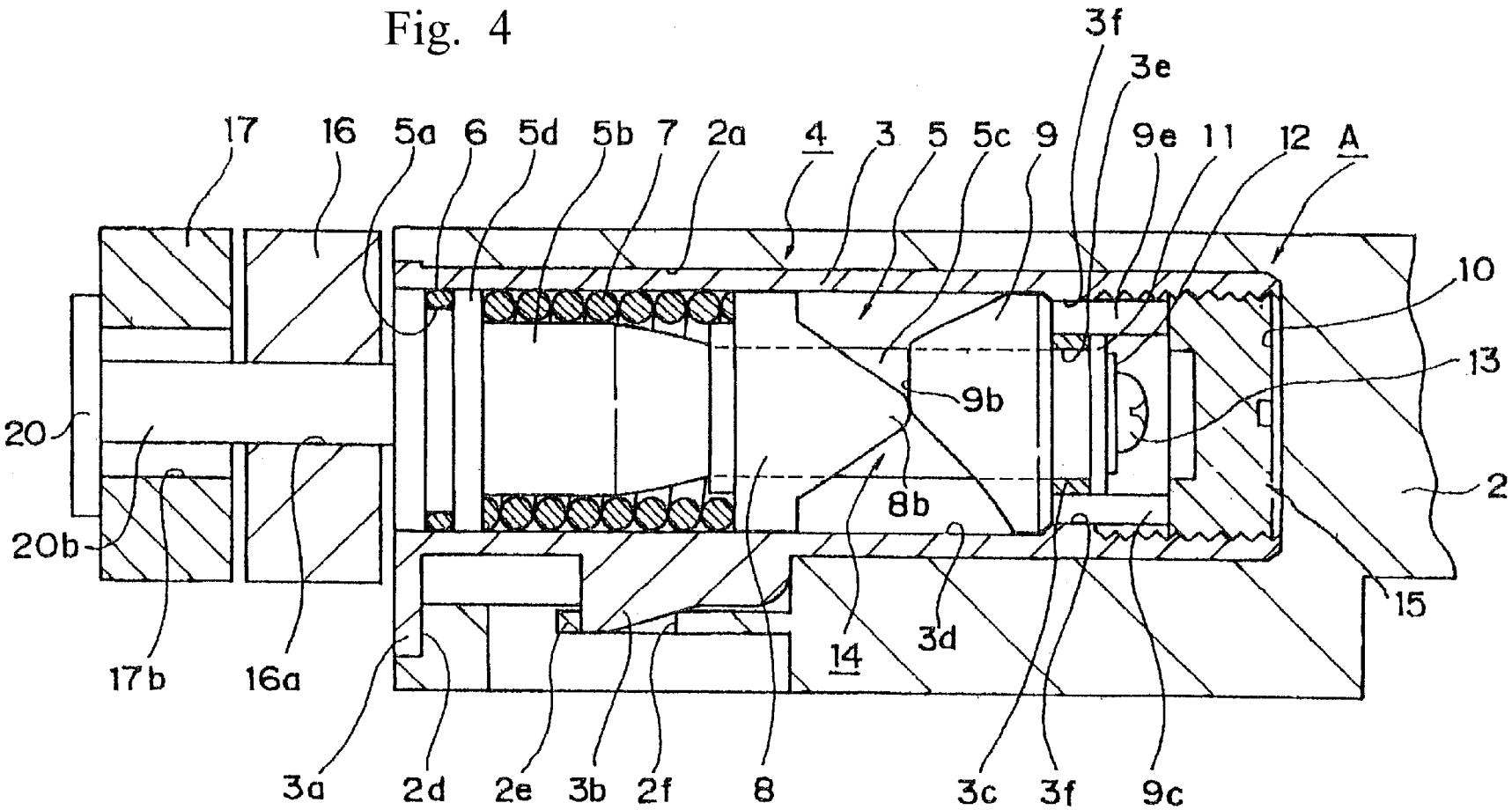
FIG. 4 is an axial-sectional view of the hinge device according to the present invention, explaining the operation of the hinge.
Figure 7:
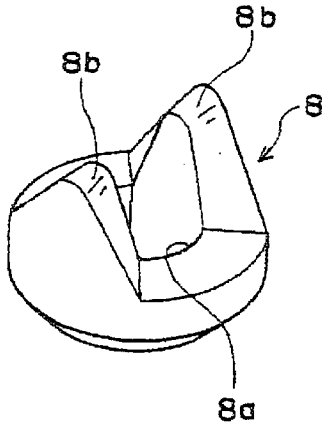
FIG. 7 is a perspective view of the rotatable sliding cam 8 included in the present invention.
Figure 8:
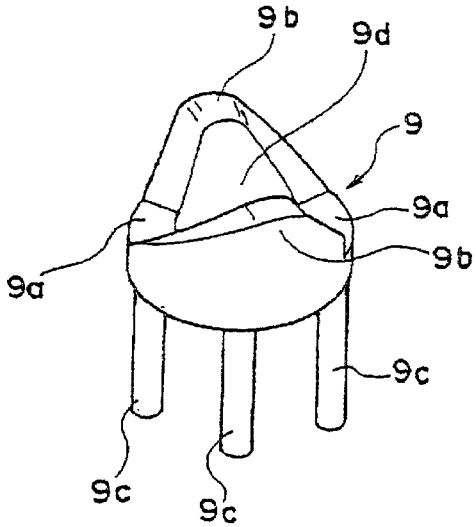
FIG. 8 is a perspective view of the stationary cam 9 included in the present invention.

A cam mechanism 14 is further included in the hinge device according to the present invention. As best shown in FIGS. 2 to 5, the rotating shaft 5 is penetrated axially rotatably in the cam mechanism 14. The rotating shaft 5 consists, as counted from the left end thereof, of a large-diameter portion 5*d* having an annular groove 5*a* formed circumferentially thereon and in which there is fitted a sealing member 6 such as an O-ring which is put in contact with an inner wall 3*d* of the hinge case 3, a medium-diameter portion 5*b* on which an elastic means 7 such as a compression spring is wound, and a small-diameter portion 5*c* having an elliptic cross-section and on which a rotatable cam 8 is fitted to be axially slidable. The partition wall 3*c* extends inwardly and radially of the hinge case 3 and has formed therein a bearing hole 3*e* in which the small-diameter portion 5*c* is supported. The partition wall 3*c* has also a hole 3*f* formed therein. The elastic means 7 is located between the large-diameter flange 5*d* and rotatable sliding cam 8 to always urge the latter in one direction (rightward in the plane of the drawing). Also, the rotatable sliding cam 8 has formed axially in the center thereof a non-circular or generally elliptic hole 8*a*. With the small-diameter non-round portion 5*c* of the rotating shaft 5 fitted in this non-circular hole 8*a*, the cam 8 can be rotated together with the rotating shaft 5. Also, the rotatable sliding cam 8 has formed in diametrical positions on one side thereof a pair of crests 8*b* projecting axially as shown in FIGS. 2 and 7. As shown in FIGS. 2 and 8, the hinge device further comprises a stationary cam 9 provided on one side of the partition wall 3*c* inside the hinge case 3. As best seen from FIG. 8, the stationary cam 9 has a pair of troughs 9*a* and a pair of crests 9*b* formed on one end thereof and both extending axially, and a plurality of projections 9*c* formed on the other end thereof and extending axially but in an opposite direction to that of the crests 9*b*. As shown in FIGS. 2 to 5, with the projections 9*c* inserted through the hole 3*f* in the partition wall 3*c*, the stationary cam 9 is secured against rotation. The stationary cam 9 has a circular hole 9*d* formed axially in the center thereof. The small-diameter portion 5*c* of the rotating shaft 5 is penetrated rotatably through the circular hole 9*d* of the stationary cam 9. Thus, when all are set inside the hinge case 3, the rotatable sliding cam 8 and stationary cam 9 are placed in such a relationship that the crests 8*b* of the rotatable sliding cam 8 are in contact with the troughs 9*a* and crests 9*b* of the stationary cam 9. The projections 9*c* of the stationary cam 9 are penetrated out to the right through the hole 3*f* in the partition wall 3*c* of the hinge case 3 and abut one end of an adjusting cap 10 screwed in an internally threaded wall of the hinge case 3. The adjusting cap 10 is included in an elasticity adjusting means 15 which serves also as a plug of the hinge case 3. By tightening or loosening the adjusting cap 10, it is possible to slide the stationary cam 9 axially, rightward or leftward, of the rotating shaft 5 in order to adjust the elasticity of the elastic means 7 via the rotatable sliding cam 8. The hinge device comprises also a stopper ring 11 rotatable along with the rotating shaft 5, a washer 12, and a fixing screw 13. The stopper ring 11 limits the rotation of the rotating shaft 5 to a predetermined range and the fixing screw 13 keeps the rotating shaft 5 engaged in the partition wall 3*c* to prevent the rotating shaft 5 from being disengaged from the hinge case 3.

Figure 5:
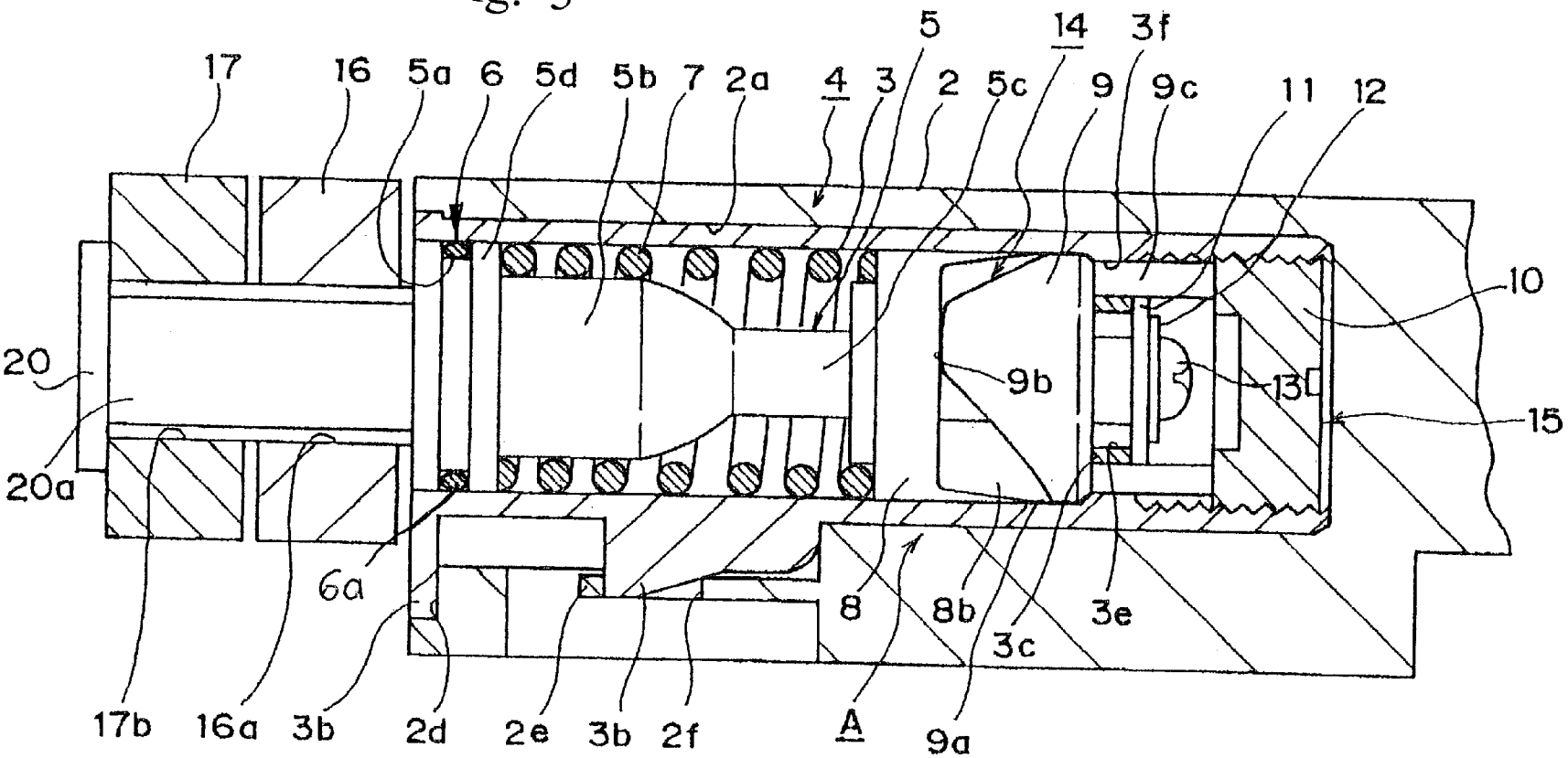
FIG. 5 is an axial-sectional view of the hinge device, explaining the operation of thereof with the seat open to an angle of 90° from the position in FIG. 4.
Figure 6:
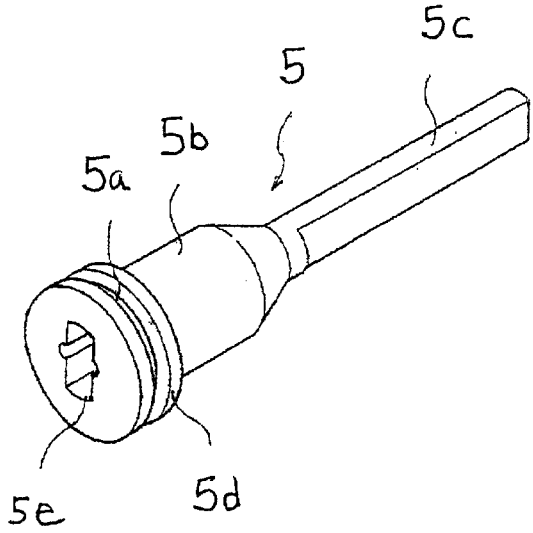
FIG. 6 is a perspective view of the rotating shaft included in the present invention.

As best seen from FIGS. 1, 5 and 6, the rotating shaft 5 has formed in a portion thereof exposed from the hinge case 3 a non-circular hole 5*e* extending axially from the end face to the central portion. In this non-circular hole 5*e* press-fitted is a fixing pin 20 which supports fixtures 16 and 17 for a seat lid and set (not shown), respectively. The fixing pin 20 consists of a non-round shaft portion 20*a* having a generally elliptic cross section. The non-round shaft portion 20*a* is inserted into a non-circular hole 16*a* formed in the seat fixture 16 and thus the fixing pin 20 is rotated along with the fixture 16 when the seat is operated The non-round shaft portion 20*a* is also inserted in a circular hole 17*b* formed in the seat lid fixture 17. Since the hole 17*b* is circular, the fixture 17 will not be rotated along with the fixing pin 20. Supported on the fixing pin 20, the seat lid is rotatable about the non-round shaft portion 20*a* of the fixing pin 20. More specifically, when the seat is operated, the rotating shaft 5 of the left-side hinge device 4 is rotated via the fixing pin 20. However, when the seat lid is operated, the rotating shaft 5 is not rotated since the seat lid is only supported by the fixing pin 20.

As shown in FIG. 1, the non-round shaft portion 20*a* of the fixing pin 20 fitted in the non-circular hole (not shown) in the rotating shaft 5 in the right-side hinge case 3 as having been described in the foregoing is pivoted in a circular hole 16*b* in a seat fixture 16. Namely, the seat fixture 16 is rotatably supported on the right-side fixing pin 20. However, the non-round shaft portion 20*a* of the fixing pin 20 is engaged in a non-circular hole 17*a* in a seat lid fixture 17 to be rotatable with the seat lid fixture 17. That is to say, the right-side hinge device A' will not work since the seat fixture 16 is only supported on the fixing pin 20 when the seat is operated while the rotating shaft 5 is not rotated. Therefore, the right-side hinge device A' in FIG. 1 is used with the seat lid while the left-side hinge device A is used with the seat.

The hinge device constructed according to the present invention as having been described in the foregoing works as will be described herebelow. When the seat is in the closed position, the crests 8*b* of the rotatable sliding cam 8 forming the cam mechanism 14 shown in FIG. 4 abut the crests 9*b*, respectively, of the stationary cam 9 and the elastic means 7 is compressed to the maximum extent. As the seat is opened from this status, the rotating shaft 5 is rotated via the fixing pin 20 on which the seat fixture 16 is engaged, the crests 8*b* of the rotatable sliding cam 8, rotated in a same direction, move from the crests 9*b* of the stationary cam 9 down into the troughs 9*a*, respectively, while the rotatable sliding cam 8 is moved towards the stationary cam 9.

Thus, the rotating shaft 5 is allowed to rotate smoothly and the seat is opened. When the cam torque at an angular position of 80 deg. of the seat is further decreased to zero at an angular position short of a position 90 deg., the seat can be forced in the opening direction and automatically set in the self-supporting position. Further, the cam torque is increased again to brake the seat in an opening direction to an angular position of 110 deg., thereby absorbing a bounding and rebounding. Thus, the seat motion can be accented elaborately fro matching with each rotation moment of the rotating shaft created when the seat is opened.

When the opened seat is closed, the cam mechanism 14 will reversely follow the aforementioned operations. However, owing to a resistance developed against the elasticity of the elastic means 7 as the crests 8*b* of the rotatable sliding cam 8 move from the troughs 9*a* of the stationary cam 9 to the crests 9*b* when the seat is closed to an angular position of about 40 deg., a counter-acting torque is generated which will cancel the rotation moment of the seat to prevent the seat from being closed abruptly.

When the seat is closed, the torque acting in an opposite direction to the action of the cam mechanism is generated to prevent the seat from dropping suddenly and provide a gentle closing of the seat.

In the foregoing, only the left-side hinge device A for the seat has been described. Also the right-side hinge device A' for the seat lid starts working at the closed position of the seat lid. However, since the seat lid is not so frequently operated starting at the closed position as the seat, the closing and opening motions of the seat lid have not to be so elaborately accented as those of the seat. Therefore, the stationary cam may be shaped more simply than that for the hinge device A for use with the seat. Basically, however, since the stationary cam generates a similar rotation moment to that for operation of the seat, the hinge device A' for the seat lid is a same structure as the hinge device A for the seat except that the stationary cam for the hinge device A' for the seat lid is designed different from that for the hinge device A for the seat. Therefore, the hinge device A' will not further be explained. This is also true for the other embodiments of the present invention.

Next, a second embodiment of the hinge device according to the present invention will be described herebelow with reference to FIGS. 9 to 15. As shown the hinge device comprises a pair of right and left hinge cases 21 having fixtures 21*a*, respectively, which are installed to the top rear of a toilet bowl 22 with fixing bolts 23, respectively. Of the hinge cases 21, the right one is for the seat hinge device B while the left one is for the seat lid hinge device B'. Of course, they may be designed to take the other's place. The right and left hinge devices B and B' are of a same basic internal structure except that they are designed symmetrical. Therefore, only the right-side hinge device B for the seat will be described below.

The hinge case 21 has formed in one end thereof a bearing hole 21*b*. A rotating shaft 24 has a generally central portion thereof born rotatably in the bearing hole 21*b*. The reference 25 indicates a sealing O-ring. The rotating shaft 24 has a portion 24*a* projected out of the hinge case 21. As best seen from FIG. 12, the portion 24*a* has a generally cross-shaped cross section. A fixing portion 26*a* of a seat lid fixing member 26 is pivoted on the portion 24*a* on which a fixing portion 27*a* of a seat fixing member 27 is also engaged rotatably with the rotating shaft 24. The fixing portion 26*a* has a circular hole 26*b* formed therein, and the fixing portion 27*a* has a non-circular hole 27*b* corresponding to the generally cross-shaped section of the fixing portion 24*a* of the rotating shaft 24. The rotating shaft 24 is inserted in the circular hole 26*b* of the seat lid fixing portion 26*a* and in the cross-shaped hole 27*b* of the seat fixing portion 27*a*.

The left-side hinge device B' has a rotating shaft 24 having a same shape as the rotating shaft 24 of the right-side hinge device B. The rotating shaft 24 of the left-side hinge device B is projected out of the left hinge case 21, and has formed therein a non-circular hole corresponding to the generally cross-shaped section of the fixing portion 26*a* of the seat lid fixing member 26. The left rotating shaft 24 is engaged in the non-circular hole to be rotatable along with the right rotating shaft 24. The fixing portion 27*a* of the seat fixing member 27 has a circular hole (not shown) formed therein. Thus, the left rotating shaft 24 is rotatable about the right rotating shaft 24. When a seat 28 is operated, the right rotating shaft 24 is rotated with the seat fixing member 27 while the left rotating shaft 24 is not. On the other hand, when the set lid is operated, the right rotating shaft 24 is not rotated while the left rotating shaft 24 is rotated.

The right hinge device B will be described again. The remainder 24*b* of the rotating shaft 24 is inserted in the hinge case 21. As shown in FIG. 13, the portion 24*b* is formed also to have a generally cross-shaped section. This non-round shaft portion 24*b* is engaged in a non-circular hole 29*a* formed axially in the central portion of a rotatable cam 29 included in a cam mechanism 34 so that the rotatable cam 29 is rotatable along with the rotating shaft 24. Note that the rotatable cam 29 may be formed integrally with the rotating shaft 24. The rotatable cam 29 has formed on the right end face thereof a rotatable cam portion 29*d* consisting of a pair of crests 29*b* and a pair of troughs 29*c*. There is provided opposite this rotatable cam portion 29*d* a sliding cam 30 which forms also a part of the cam mechanism 34. The sliding cam 30 has a circular hole formed axially in the central portion thereof. The non-round shaft portion 24*b* of the rotating shaft 24 is rotatably penetrated through the circular hole in the sliding cam 30. The sliding cam 30 has formed axially on the outer surface thereof projections 30*b* which are fitted in elongated recesses 21*c* formed in the hinge case 21. Thus, the sliding cam 30 is slid axially without being rotated along with the rotating shaft 24. The hinge case 21 has attached on the right open end face thereof an adjusting cap 31 of an adjusting means 36 serving also as an adjusting screw. An elastic means 32 formed from a compression spring is provided between the adjusting cap 31 and sliding cam 30. The elastic means 32 urges to slide the sliding cam 30 in one direction and press to the rotatable cam portion 29 a sliding cam portion 30*e* included in the sliding cam 30 and consisting of a pair of crests 30*c* and troughs 30*d*.

Figure 9:
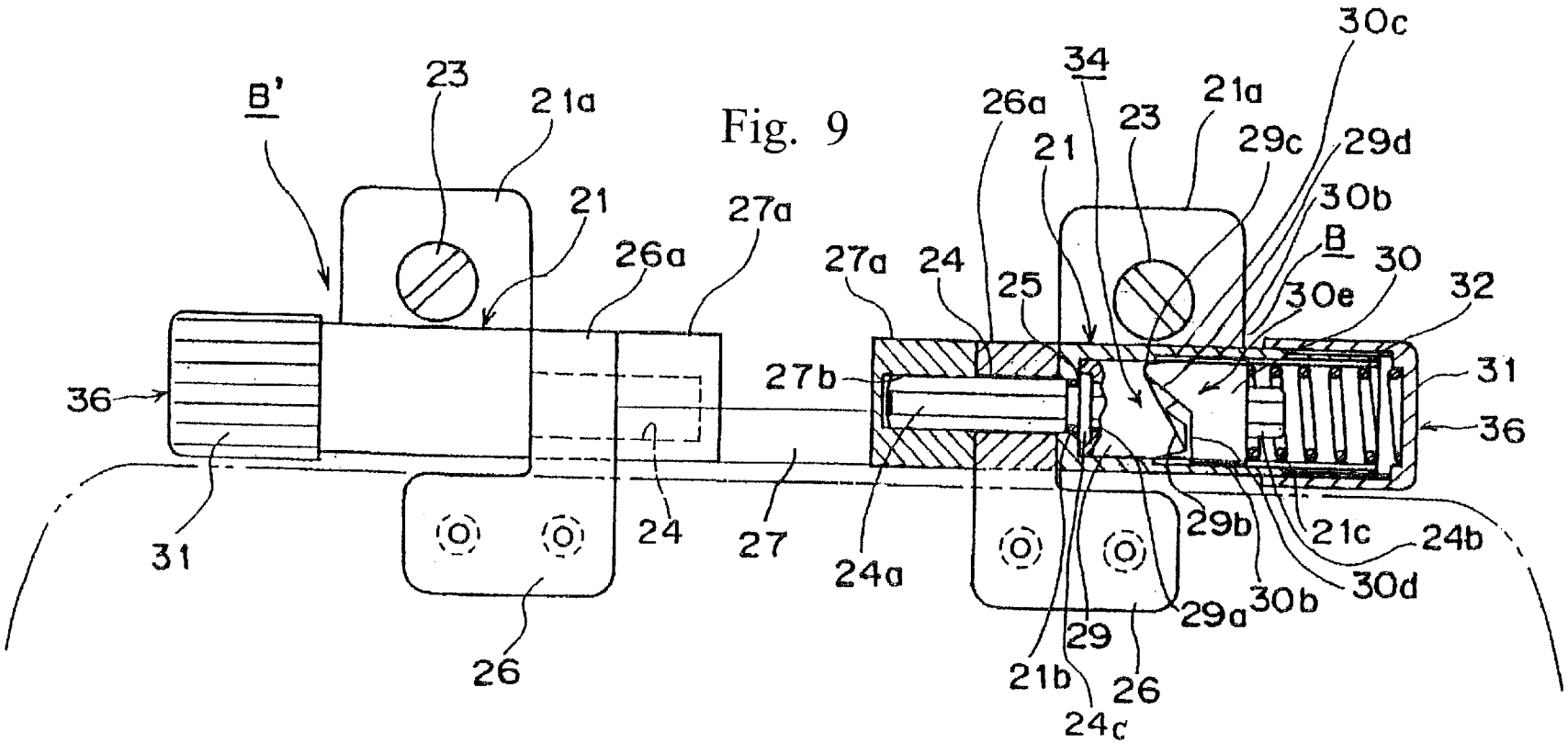
FIG. 9 is a partially sectional plan view of a second embodiment of the hinge device according to the present invention.
Figure 1:
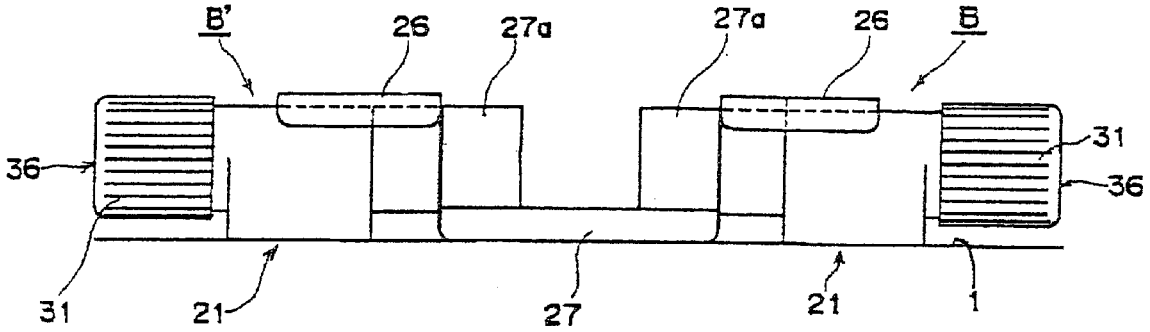
Figure 1:
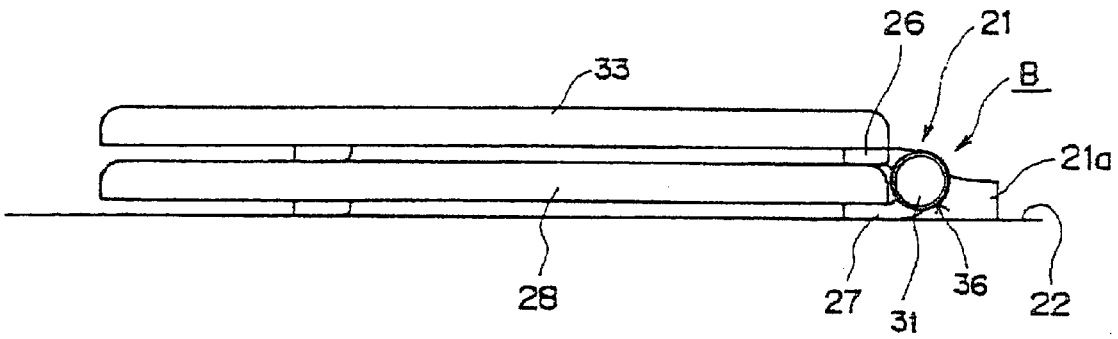
Figure 1:
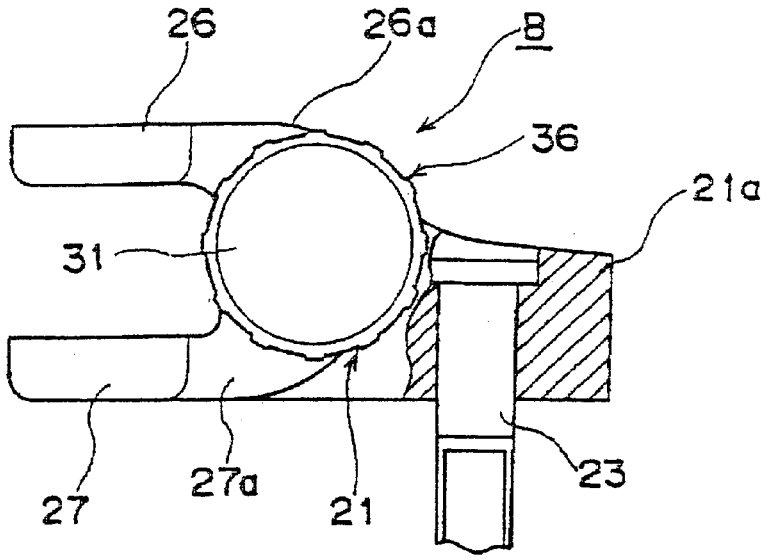
Figure 1:
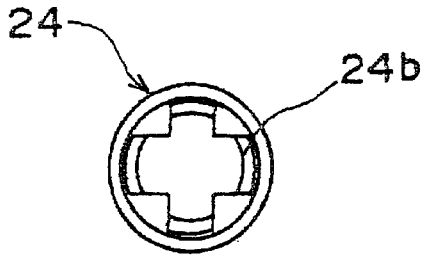
Figure 1:
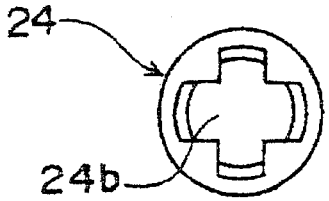

Therefore, as the seat 28 shown in FIG. 15 is opened, the rotating shaft 24 is rotated along with the rotatable cam 29. At this time, the crests 29*b* of the rotatable cam portion 29*d* of the rotatable cam 29 will move rotationally between the crests 30*c* and troughs 30*d* of the sliding cam portion 30*e* of the sliding cam 30. Thus, the seat 28 can be opened lightly while the crests 29*b* of the rotatable cam portion 29*d* of the rotatable cam 29 move from the troughs 30*c* to the troughs 30*d* of the sliding cam 30, and can be stably held open because the crests 29*b* fall in the troughs 30*d* as shown in FIG. 9. As the seat 28 is closed, the crests 29*b* of the rotatable cam portion 29*d* encounter a resistance when they leave the troughs 30*d* of the sliding cam portion 30*e* and move to the crests 30*c*, so that the seat 28 will not be closed abruptly.

Figure 14:
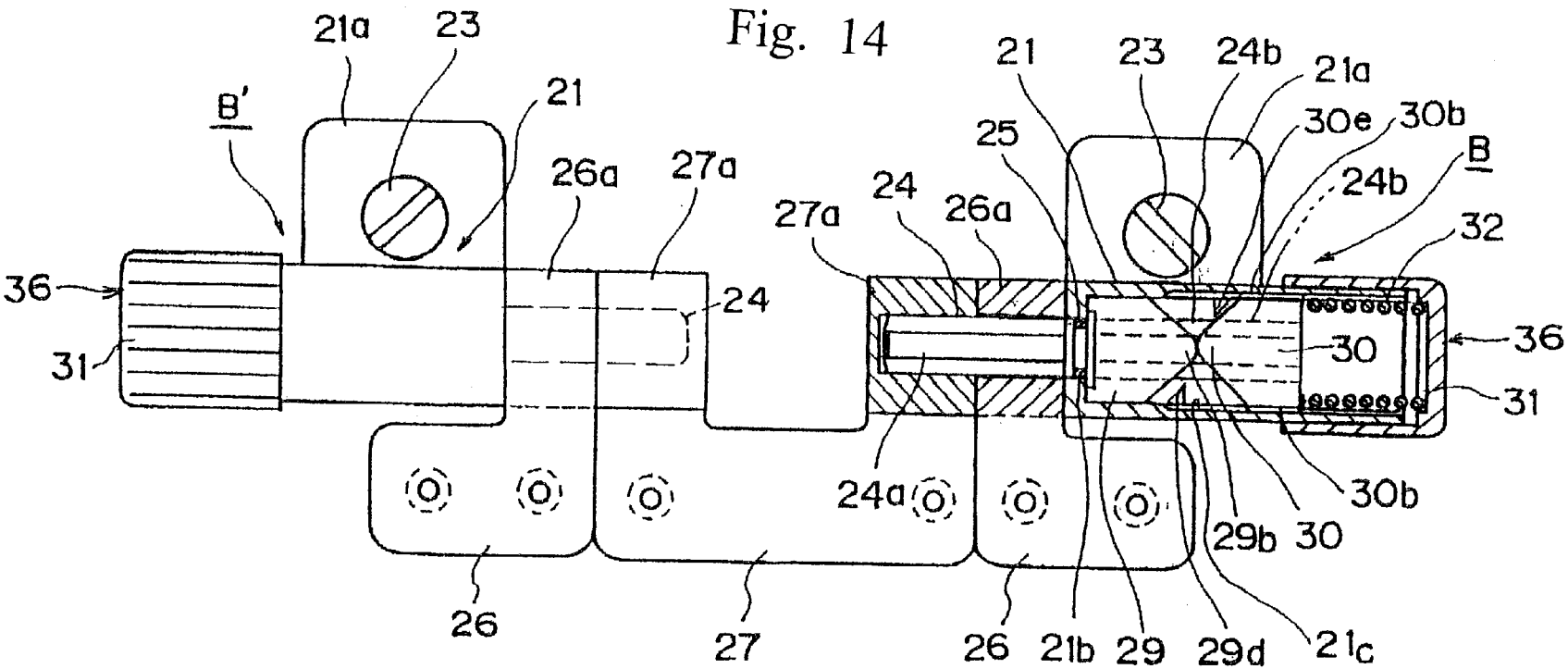
FIG. 14 explains the function of the hinge device in FIG. 9.

FIGS. 14 and 15 show the seat 28 closed as in the above. By turning the adjusting cap 31 (which serves also as an adjusting screw) relative to the hinge case 21, it is possible to accent the elasticity of the elastic means 32. Therefore, the pressure under which the sliding cam portion 30*e* of the sliding cam 30 is pressed to the rotatable cam portion 29*d* of the rotatable cam 29 can be elaborately regulated, which permits a fine adjustment of the torque of the rotating shaft 24, and thus the operating feeling of the seat 28. The reference numeral 33 in FIG. 15 indicates a seat lid. When opening or closing the seat lid 33, the left-side hinge device B' works to control the operation of the seat lid 33.

Figure 16:
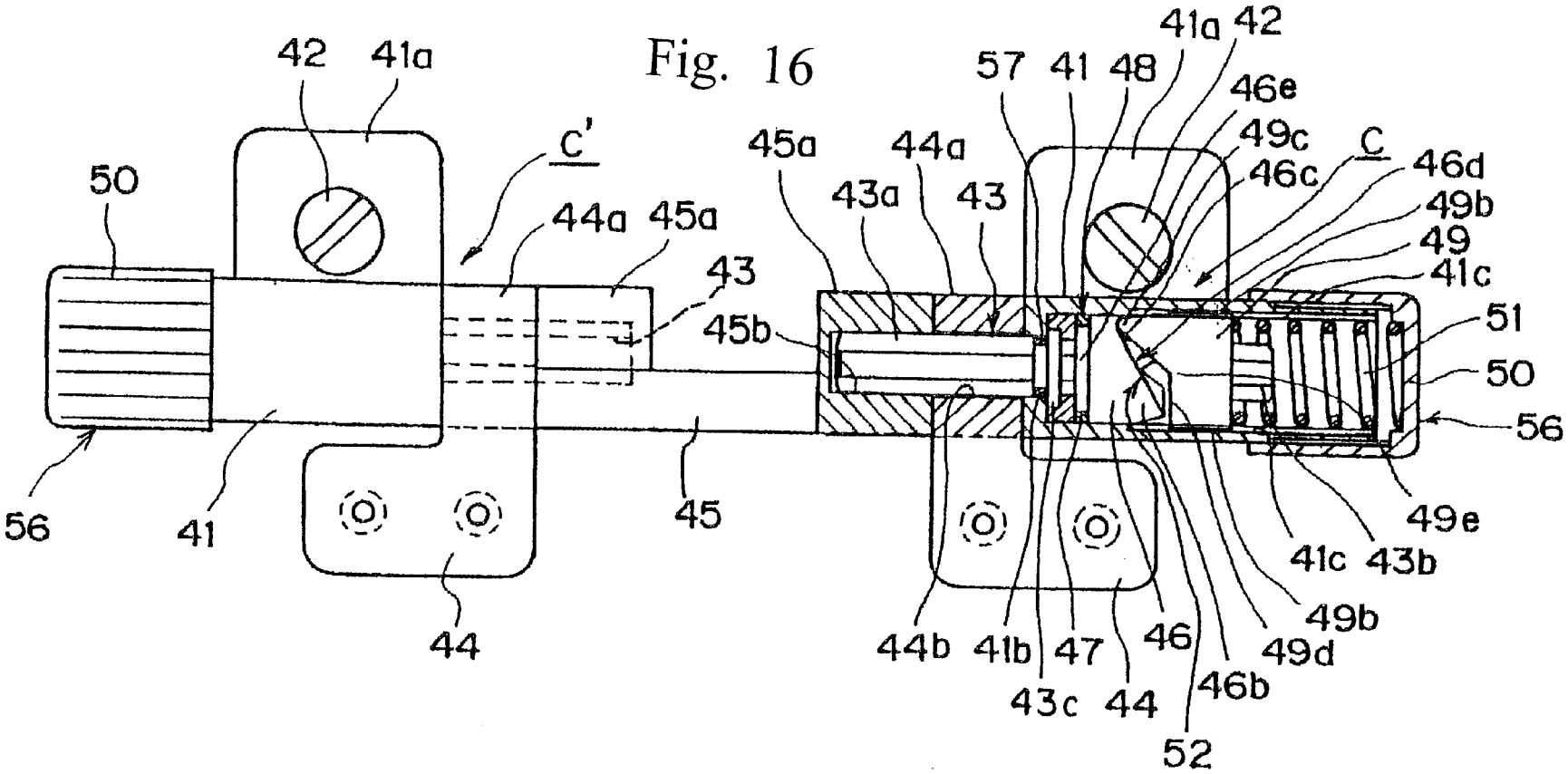
FIG. 16 is a partially sectional plan view of a third embodiment of the hinge device according to the present invention.

Next, a third embodiment of the hinge device according to the present invention will be described herebelow with reference to FIG. 16. As shown, the hinge device comprises a pair of right and left hinge cased 41 having fixtures 41*a*, respectively, which are installed to the top rear of a toilet bowl with fixing bolts 42, respectively. Of the hinge cases 41, the right one is for the seat hinge device C while the left one is for the seat lid hinge device C'. Of course, they may be designed to take the other's place. The right and left hinge devices C and C' are of a same basic internal structure except that they are designed symmetrical. Therefore, only the right-side hinge device C for the seat will be described below.

The hinge case 41 has formed therein a bearing hole 41*b*. A rotating shaft 43 has a generally central portion thereof born rotatably in the bearing hole 41*b*. The reference 53 indicates a sealing O-ring. The rotating shaft 43 has a portion 43*a* projected out of the hinge case 41. Similarly to the corresponding portion shown in FIGS. 12 and 13, the portion 43*a* has a generally cross-shaped cross section. A fixing portion 44*a* of a seat lid fixing member 44 is pivoted on the portion 43*a* on which a fixing portion 45*a* of a seat fixing member 45 is also engaged rotatably with the rotating shaft 43. The fixing portion 44*a* has a circular hole 44*b* formed therein, and the fixing portion 45*a* has a non-circular hole 45*b* corresponding to the generally cross-shaped section of the fixing portion 43*a* of the rotating shaft 43. The rotating shaft 43 is inserted in the circular hole 44*b* of the seat lid fixing portion 44*a* and in the cross-shaped hole 45*b* of the seat fixing portion 45*a*.

The left-side hinge device C' has a rotating shaft 43 having a same shape as the rotating shaft 43 of the right-side hinge device C. The rotating shaft 43 of the left-side hinge device C is projected out of the left hinge case 41, and has formed therein a non-circular hole corresponding to the generally cross-shaped section of the fixing portion 44*a* of the seat lid fixing member 44. The left rotating shaft 43 is engaged in the non-circular hole to be rotatable along with the right rotating shaft 43. The fixing portion 45*a* of the seat fixing member 45 has a circular hole (not shown) formed therein. Thus, the left rotating shaft 43 is rotatable about the right rotating shaft 43. When a seat (not shown) is operated, the right rotating shaft 43 is rotated with the seat fixing member 45 while the left rotating shaft 43 is not. On the other hand, when the seat lid is operated, the right rotating shaft 43 is not rotated while the left rotating shaft 43 is rotated.

The right hinge device C will be described again. The remainder 43*b* of the rotating shaft 43 is inserted in the hinge case 41. The portion 43*b* is formed also to have a generally cross-shaped section. This non-round shaft portion 43*b* is engaged in a non-circular hole (not shown) formed axially in the central portion of a rotatable cam 46 included in a cam mechanism 52 so that the rotatable cam 46 is rotatable along with the rotating shaft 43. Note that the rotatable cam 46 may be formed integrally with the rotating shaft 43. The rotatable cam 46 has formed in the outer surface thereof a circumferential groove 46*e* in which a rubber ring 47 is fitted to press the inner wall of the hinge case 41. A viscous oil (not shown) is applied between the rubber ring 47 and hinge case 41 to form a damping means 48. The rotatable cam 46 has formed on the right end face thereof a rotatable cam portion 46*d* consisting of a pair of crests 46*b* and a pair of troughs 46*c*. There is provided opposite this rotatable cam portion 46*d* a sliding cam 49 which forms also a part of the cam mechanism 52. The sliding cam 49 has a circular hole formed axially in the central portion thereof. The rotating shaft 43 is rotatably penetrated through the circular hole in the sliding cam 49. The sliding cam 49 has formed axially on the outer surface thereof projections 49*b* which are fitted in elongated recesses 41*c* formed in the hinge case 41. Thus, the sliding cam 49 is slid axially without being rotated along with the rotating shaft 43. The hinge case 41 has attached on the right open end face thereof an adjusting cap 50 of an adjusting means 56 serving also as an adjusting screw. An elastic means 51 formed from a compression spring is provided between the adjusting cap 50 and sliding cam 49. The elastic means 51 urges to slide the sliding cam 49 in one direction and press to the rotatable cam portion 46 a sliding cam portion 49*e* included in the sliding cam 49 and consisting of a pair of crests 49*c* and troughs 49*d*.

Therefore, as the seat is opened, the rotating shaft 43 is rotated along with the rotatable cam 46. At this time, the crests 46*b* of the rotatable cam portion 46*d* of the rotatable cam 46 will move rotationally between the crests 49*c* and troughs 49*d* of the sliding cam portion 49*e* of the sliding cam 49. Thus, the seat can be opened lightly while the crests 46*b* of the cam portion 46*d* of the rotatable cam 46 move from the troughs 49*c* to the troughs 49*d* of the sliding cam 49, and can be stably held open because the crests 46*b* fall in the troughs 49*d* as shown in FIG. 16. As the seat is closed, the crests 46*b* of the rotatable cam portion 46*d* of the rotatable cam 46 encounter a resistance when they leave the troughs 49*d* of the sliding cam portion 49*e* and move to the crests 49*c*, so that the seat will not be closed abruptly.

The closing operation of the seat is damped by the damping means 48, which permits the seat to be closed very softly. By turning the adjusting cap 50 as the adjusting means 56 which serves also as an adjusting screw in relation to the hinge case 41, it is possible to accent the elasticity of the elastic means 51, to thereby elaborately regulate the pressure under which the sliding cam portion 49*e* of the sliding cam 49 is forced to the rotatable cam portion 46*d* of the rotatable cam 46, which permits a fine adjustment of the torque of the rotating shaft 43, and thus the feeling of the seat operation.

Figure 17:
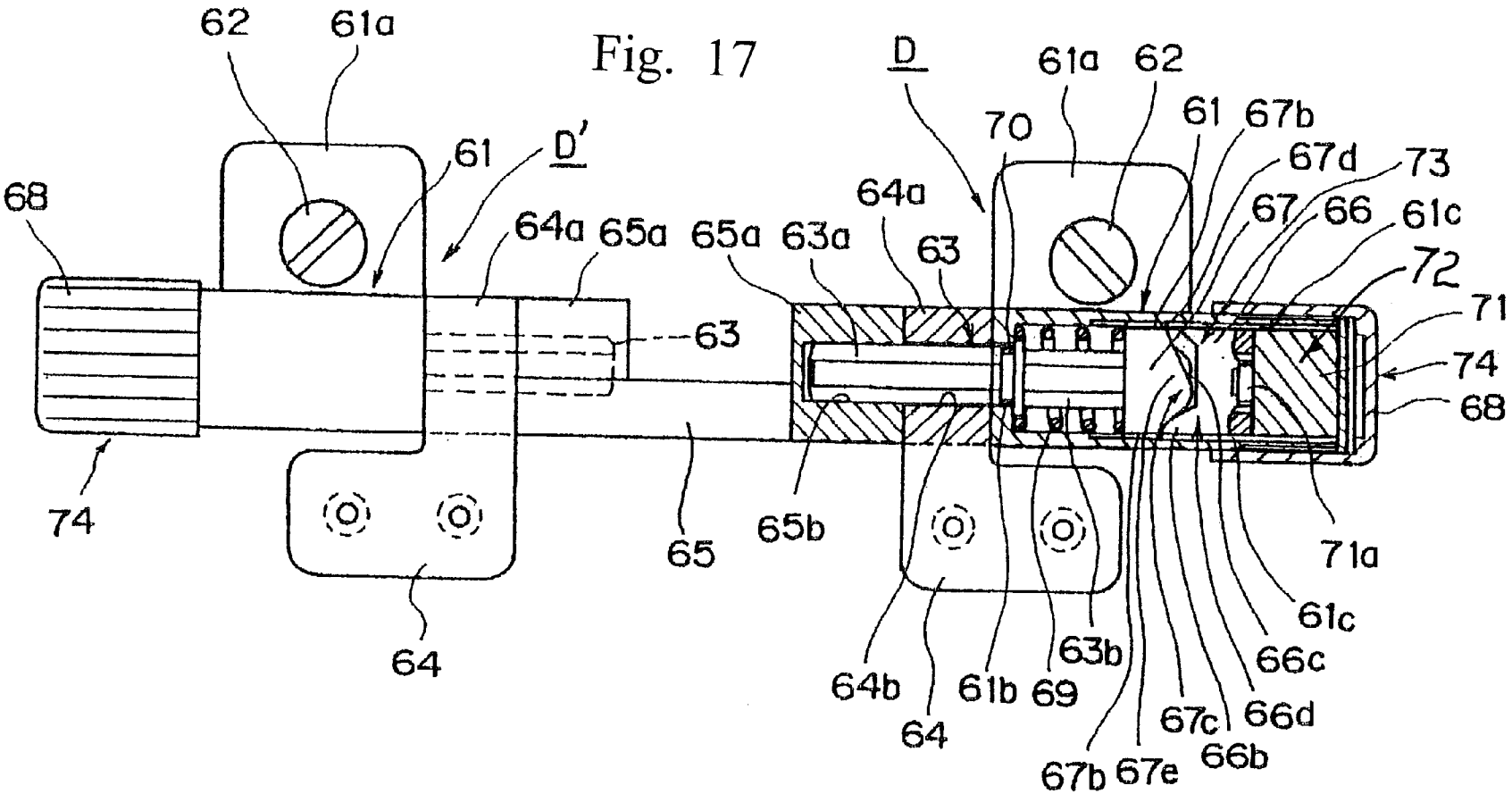
FIG. 17 is a partially sectional plan view of a fourth embodiment of the hinge device according to the present invention.
Figure 18:
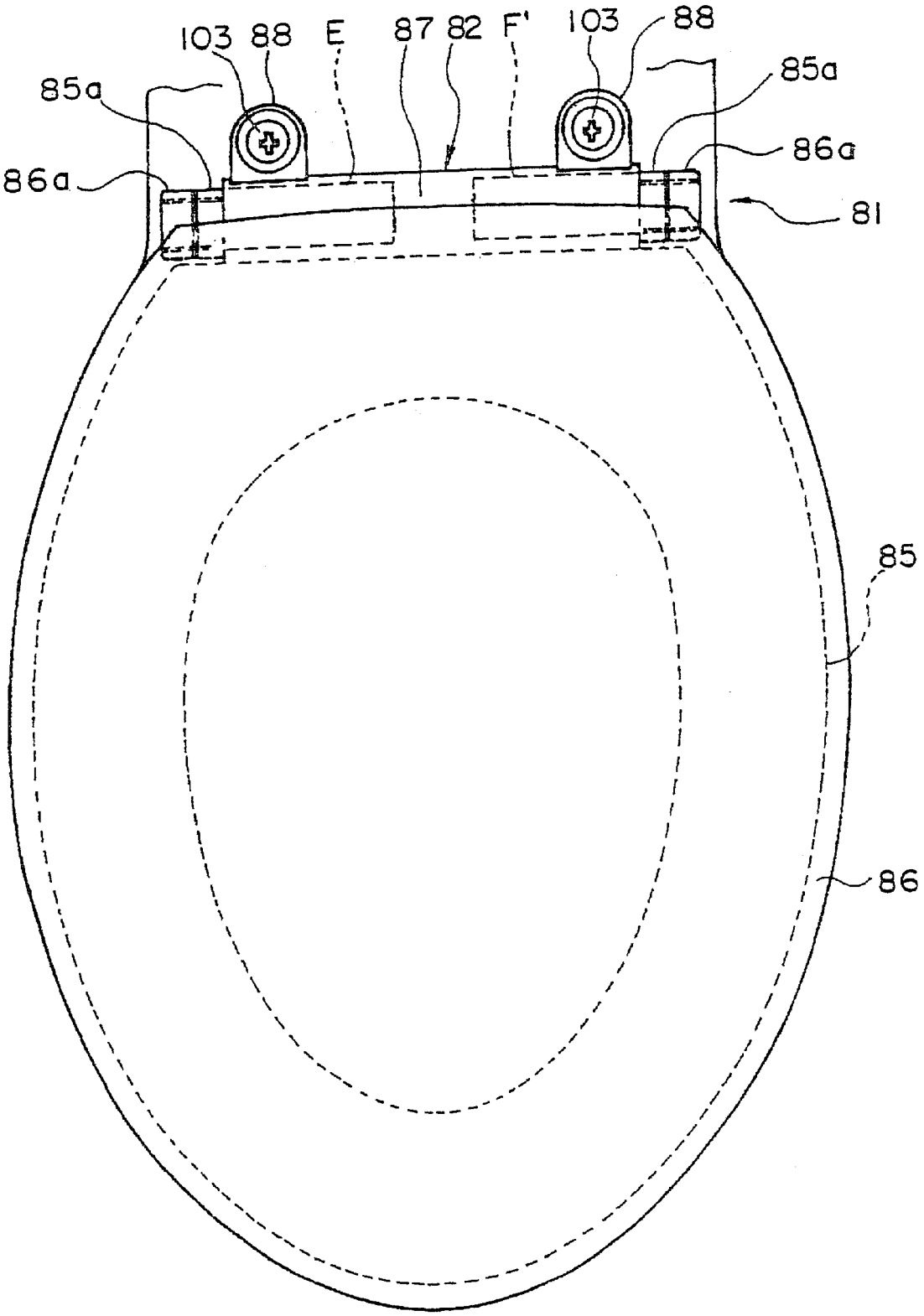
FIG. 18 is a plan view of a toilet bowl provided with the hinge device according to the present invention.
Figure 19:
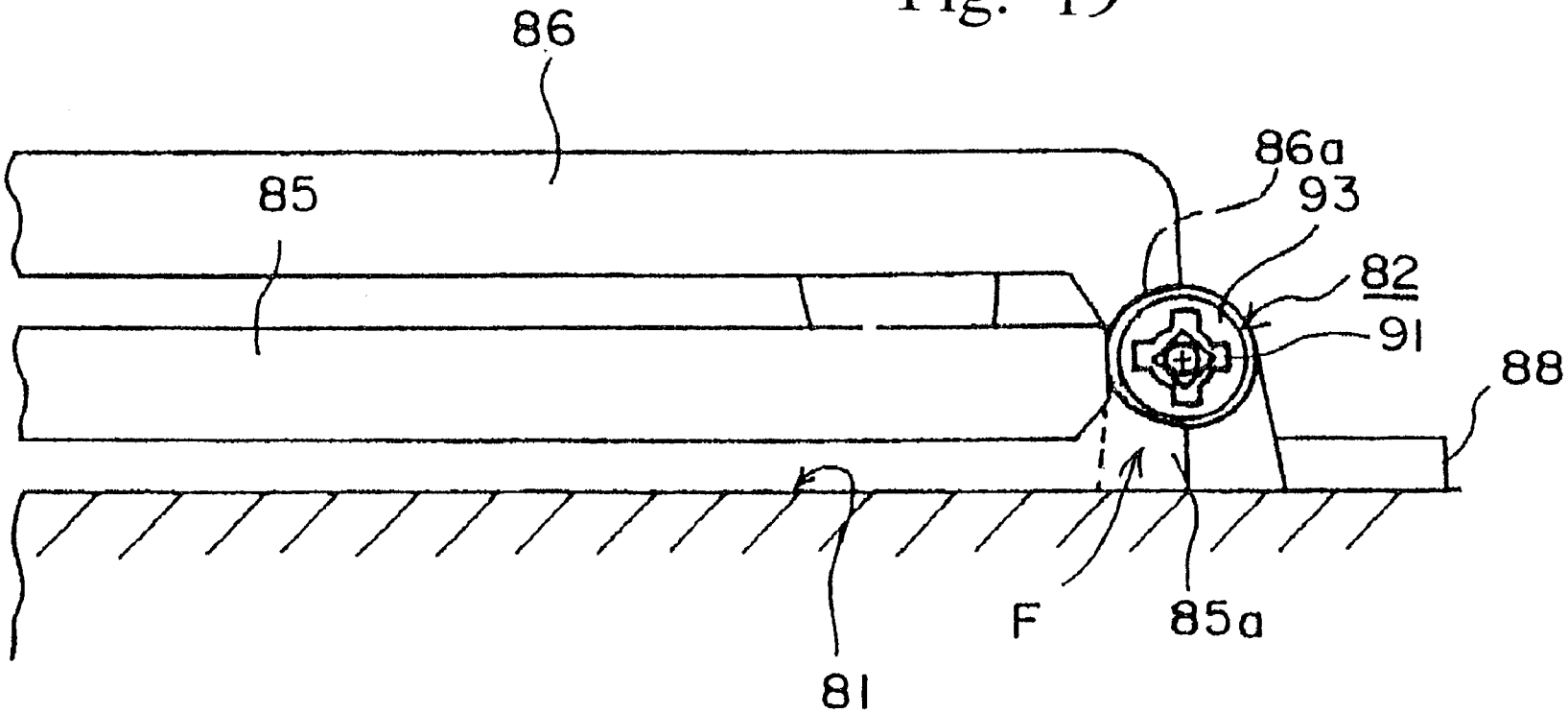
FIG. 19 is a side elevation of the hinge device in FIG. 18, with some parts being omitted.
Figure 20:
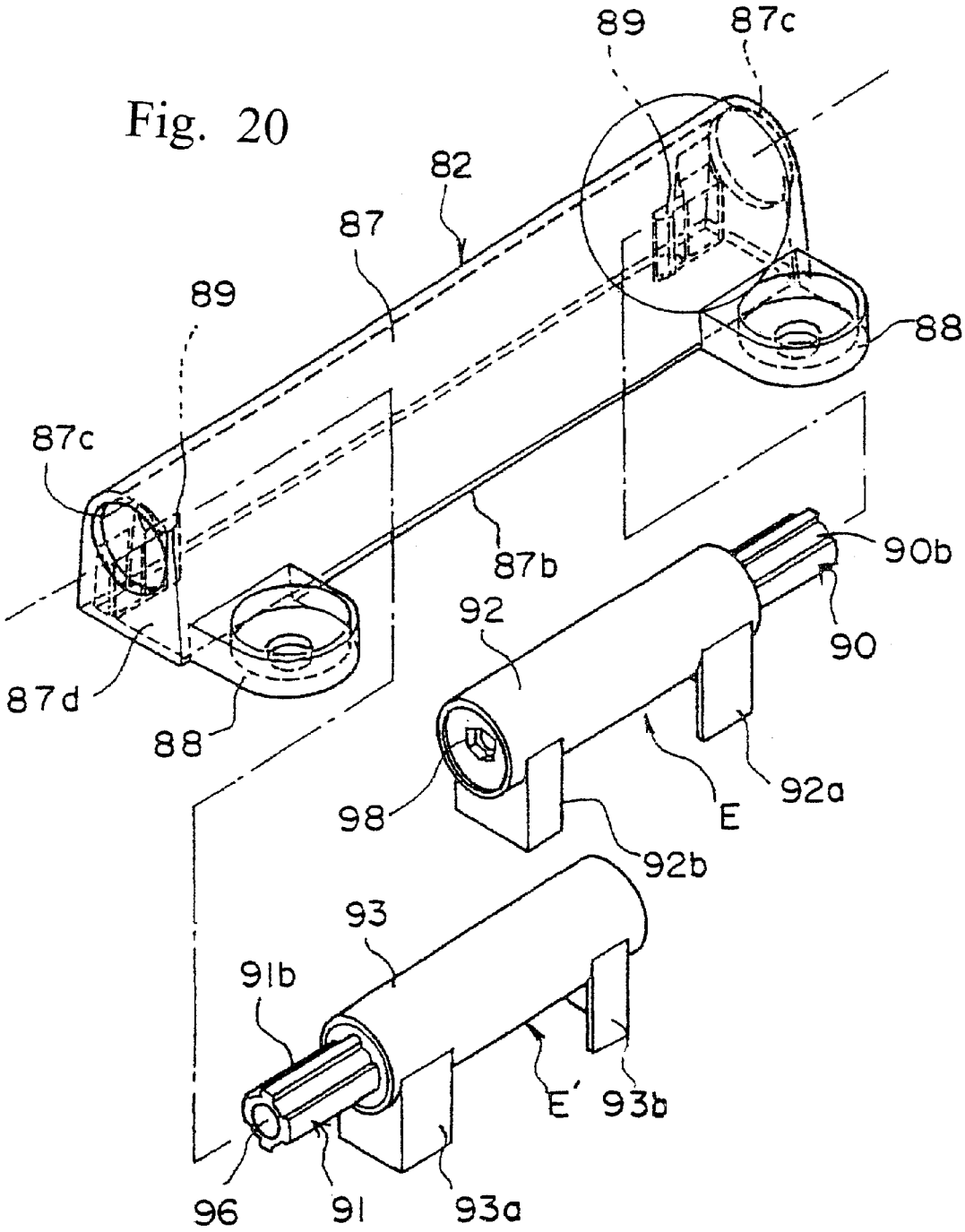
FIG. 20 is an exploded perspective view of the hinge device of the present invention, showing the installation of the hinge device to a seat and seat lid of a toilet bowl.

Next, a fourth embodiment of the hinge device according to the present invention will be described herebelow with reference to FIG. 17. As shown, the hinge device comprises a pair or right and left hinge cases 61 having fixtures 61*a*, respectively, which are installed to the top rear of a toilet bowl with fixing bolts 62, respectively. Of the hinge cases 61, the right one is for the seat hinge device D while the left one is for the seat lid hinge device D'. Of course, they may be designed to take the other's place. The right and left hinge devices D and D' are of a same basic internal structure except that they are designed symmetrical. Therefore, only the right-side hinge device D for the seat will be described below.

The hinge case 61 has formed therein a bearing hole 61*b*. A rotating shaft 63 has a generally central portion thereof born rotatably in the bearing hole 61*b*. The reference 70 indicates a sealing O-ring. The rotating shaft 63 has a portion 63*a* projected out of the hinge case 61. Similarly to the corresponding portion shown in FIG. 13, the portion 63*a* has a generally cross-shaped cross section. A fixing portion 64*a* of a seat lid fixing member 64 is pivoted on the portion 63*a* on which a fixing portion 65*a* of a seat fixing member 65 is also engaged rotatably with the rotating shaft 63. The fixing portion 64*a* has a circular hole 64*b* formed therein, and the fixing portion 65*a* has a non-circular hole 65*b* corresponding to the generally cross-shaped section of the fixing portion 63*a* of the rotating shaft 63. The rotating shaft 63 is inserted in the circular hole 64*b* of the seat lid fixing portion 64*a* and in the cross-shaped hole 65*b* of the seat fixing portion 65*a*.

The left-side hinge device D' has a rotating shaft 63 having a same shape as the rotating shaft 63 of the right-side hinge device D. The rotating shaft 63 of the left-side hinge device D is projected out of the left hinge case 61, and has formed therein a non-circular hole corresponding to the generally cross-shaped section of the fixing portion 64*a* of the seat lid fixing member 64. The left rotating shaft 63 is engaged in the non-circular hole to be rotatable along with the right rotating shaft 63. The fixing portion 65*a* of the seat fixing member 65 has a circular hole (not shown) formed therein. Thus, the left rotating shaft 63 is rotatable about the right rotating shaft 63. When a seat is operated, the right rotating shaft 63 is rotated with the seat fixing member 65 while the left rotating shaft 63 is not. On the other hand, when the seat lid is operated, the right rotating shaft 63 is not rotated while the left rotating shaft 63 is rotated.

The right hinge device D will be described again. The remainder 63*b* of the rotating shaft 63 is inserted in the hinge case 61. The portion 63*b* is formed also to have a generally cross-shaped section. This non-round shaft portion 63*b* is engaged in a non-circular hole (not shown) formed axially in the central portion of a rotatable cam 66 included in a cam mechanism 73 so that the rotatable cam 66 is rotatable along with the rotating shaft 63. Note that the rotatable cam 66 may be formed integrally with the rotating shaft 63. There is connected to the rotatable cam 66 a rotating shaft 71*a* of a rotation damper 71 having a well-known structure and included in a damping means 72. The rotation damper 71 is installed axially slidably inside the hinge case 61. Thus the rotation damper 71 controls the torque of the rotatable cam 66, namely, of the rotating shaft 63. The rotation damper 71 abuts an adjusting cap 68 included in an adjusting means 74 which serves also as an adjusting screw. The adjusting cap 68 is screwed on the hinge case 61. The rotatable cam 66 has formed on the left end face thereof a rotatable cam portion 66*d* consisting of a pair of crests 66*b* and a pair of troughs 66*c*. There is provided opposite this rotatable cam portion 66*d* a sliding cam 67 which forms also a part of the cam mechanism 73. The sliding cam 67 has a circular hole formed axially in the central portion thereof. The rotating shaft 63 is rotatably penetrated through the circular hole in the sliding cam 67. The sliding cam 67 has formed axially on the outer surface thereof projections 67*b* which are fitted in elongated recesses 61*c* formed in the hinge case 61. Thus, the sliding cam 67 is slid axially without being rotated along with the rotating shaft 63. An elastic means 69 formed from a compression spring is wound on the rotating shaft 63 between the sliding cam 67 and the left end of the hinge case 61. The elastic means 69 urges to slide the sliding cam 67 in one direction and press to the rotatable cam portion 66 a sliding cam portion 67*e* included in the sliding cam 67 and consisting of a pair of crests 67*c* and troughs 67*d*.

Therefore, as the seat is opened, the rotating shaft 63 is rotated along with the rotatable cam 66. At this time, the crests 66*b* of the rotatable cam portion 66*d* of the rotatable cam 66 will move rotationally between the crests 67*c* and troughs 67*d* of the sliding cam portion 67*e* of the sliding cam 67. Thus, the seat can be opened lightly while the crests 66*b* of the rotatable cam portion 66*d* of the rotatable cam 66 move from the crests 67*c* to the troughs 67*d* of the sliding cam 67*e*, and thus the seat can be stably held open because the crests 66*b* fall in the troughs 67*d* as shown in FIG. 17. As the seat is closed, the crests 66*b* of the rotatable cam portion 66*d* encounter a resistance when they leave the troughs 67*d* of the sliding cam portion 67*e* and move to the crests 67*c*, so that the seat will not be closed abruptly.

Thus, the seat can softly be closed under the control of the rotation damper 71 as well. By turning the adjusting cap 68 as the adjusting means 74 which serves also as an adjusting screw in relation to the hinge case 61, it is possible to regulate the elasticity of the elastic means 69, that is, the pressure under which the sliding cam portion 67*e* of the sliding cam 67 is forced to the rotatable cam portion 66*d* of the rotatable cam 66, which permits a fine adjustment of the torque of the rotating shaft 63, and thus the feeling of the seat operation.

Further, a fifth embodiment of the hinge device according to the present invention will be described herebelow with reference to FIGS. 18 to 30. In Figures, the reference 98 indicates the body of a toilet bowl, 82 a holder, and E and E' hinge devices for a seat 85 and a seat lid 86, respectively, removably installed in the holder 82.

The holder 82 consists of a case body 87 molded from a synthetic resin to have a generally barrel-roof shape, open at the bottom thereof (as indicated with a reference 87*b*) and having an insertion hole 87*c* formed in either end thereof, a pair of fixtures 88 formed integrally and projected from one side of the case body 87, and engagement pieces 89 provided on one inner wall of the case body 87 in the proximity of the holes 87*c* at the opposite ends of the case body 87.

A pair of hinge devices E and E' is inserted into the case body 87 of the holder 82 from the open bottom 87*b*. The hinge devices E and E' comprise hinge cases 92 and 93 and rotating shafts 90 and 91 projected out of the hinge cases 92 and 93, respectively, from the holes 87*c* of the case bodies 87. The hinge case 92 of the hinge device E has legs 92*a* and 92*b* projecting downward and the hinge case 93 of the hinge device E' has legs 93*a* and 93*b* projecting downward. The legs 92*a* and 93*a* are engaged in the engagement pieces 89, respectively, to secure the hinge cases 92 and 93. The inside diameter of the holes 87*c* formed in the ends of the holder 82 is equal to or smaller than the outside diameter of the hinge cases 92 and 93 of the hinge devices E and E', respectively, placed inside the holder 82. The case body 87 has a lateral plate 87*d* on either end thereof to prevent the hinge devices E and E' once put in the case body 87 from coming axially from the insertion holes 87*c*.

Figure 22:
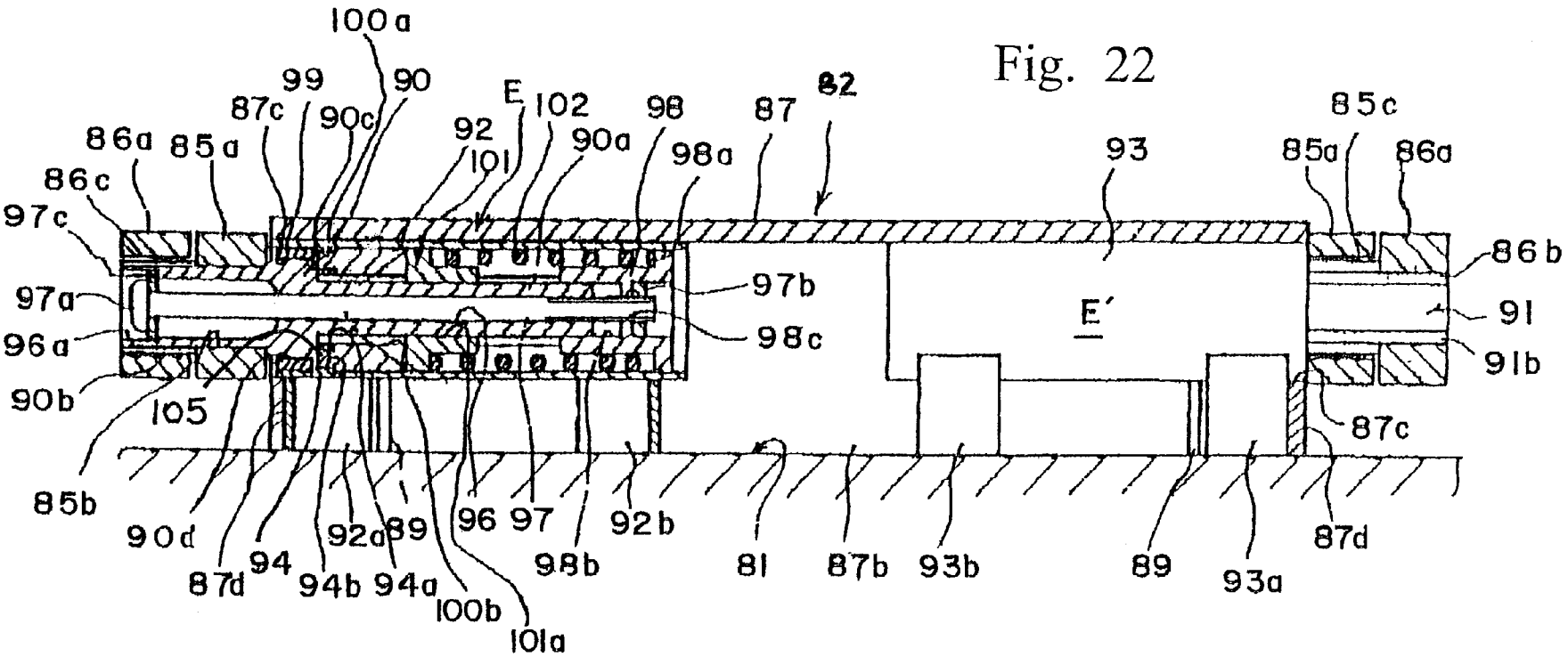
FIG. 22 is a partially cross-sectional front view of the hinge device of the present invention, installed to the seat and seat lid of a toilet bowl.

Of the pair of hinge devices E and E' set inside the case body 87 of the holder 82, the left one in FIG. 22 is for use with a seat 85 and the right one is for use with a seat lid 86. The hinge devices E and E' are of a same basic internal structure except that for a main reason that the seat 85 differs in weight from the seat lid 86, the elasticity of an elastic means formed from a compression spring and shape of a cam portion of a cam member are different between the hinge devices E and E'. Therefore, this embodiment will be described below concerning the hinge device E for the seat.

Figure 21:
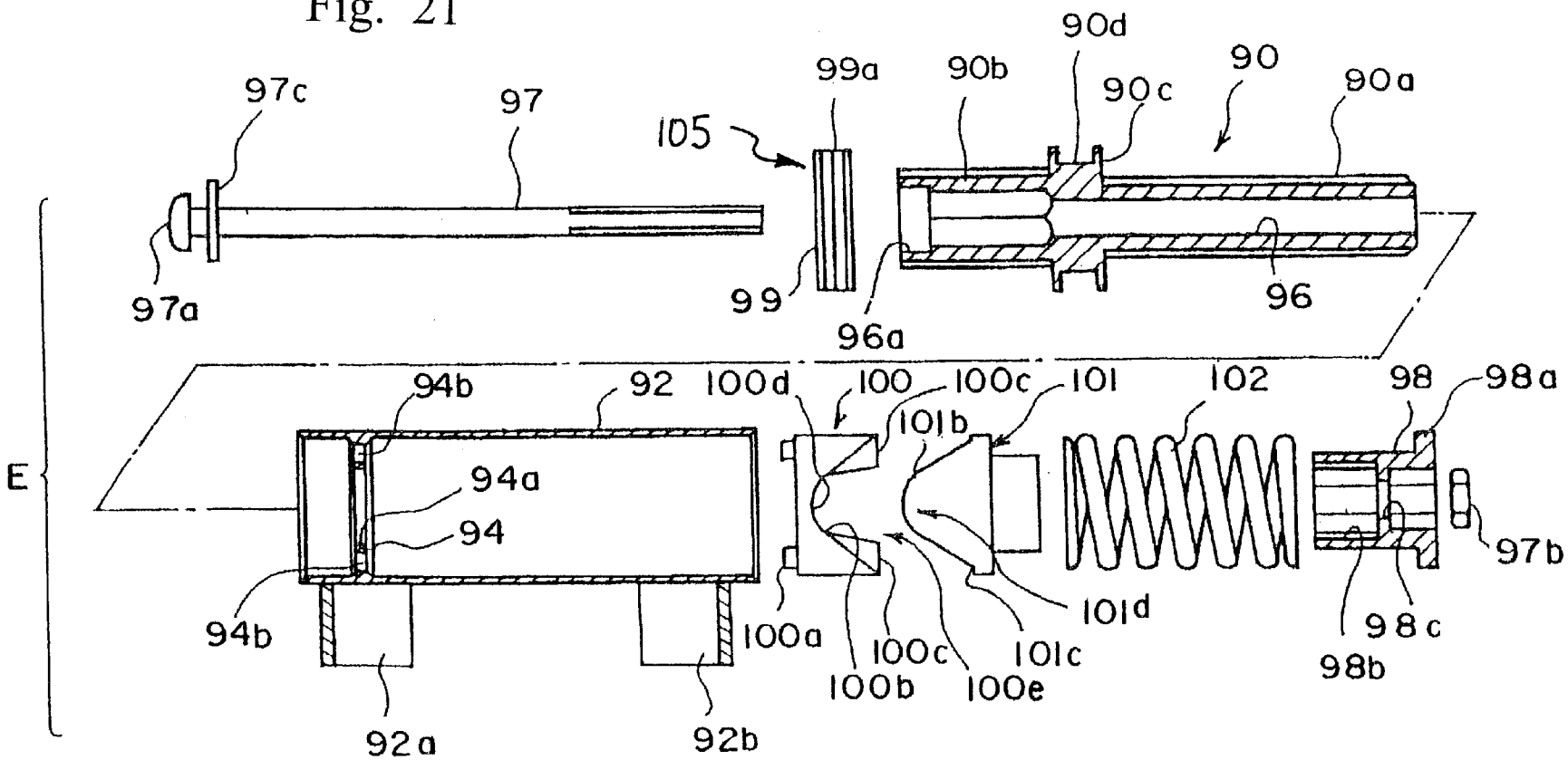
FIG. 21 is a partially axial-sectional exploded front view of the hinge device of the present invention, installed to the seat and seat lid of a toilet bowl.

As shown in FIG. 21, the legs 92*a* and 92*b* in pair are provided with a predetermined space between them on the bottom of the cylindrical hinge case 92. One of the legs 92*a* is engaged in the engagement piece 89 provided inside the case body 87 of the holder 82 when the hinge device E is put into the case body 87 to block the hinge device E from moving axially inside the case body 87. The bottom end faces of these legs 92*a* and 92*b* will be flush with the bottom plane of the case body 87 when the hinge device E is set in the case body 87.

As also seen from FIG. 21, there is provided inside the hinge case 92 of the hinge device E a partition wall 94 formed near the left end of the hinge case 92. The partition wall 94 has formed therein a bearing hole 94*a* through which the rotating shaft 90 is axially penetrated inside the hinge case 92 to be rotatable. The rotating shaft 90 has formed axially in the central portion thereof a stepped through-hole 96 through which an adjusting screw 97 is penetrated. The through-hole 96 has a large-diameter portion 96*a* in which a head 97*a* of the adjusting screw 97 is engaged. The free end of the adjusting screw 97 inside the case body 87 is projected out of the end of the rotating shaft 90. There is screwed on the projected portion of the adjusting screw 97 a nut 97*b* on which a spring holder 98 rests. The reference 97*c* indicates a washer. The spring holder 98 has formed at one end thereof a flange 98*a* which is in contact with the inner wall of the hinge case 92, and it further has a non-circular hold 98*b* formed axially in the central portion thereof at the other end thereof. The rotating shaft 90 has a non-round small-diameter portion 90*a* is engaged in the non-circular hole 98*b*. Thus, the spring holder 98 is rotatable with the rotating shaft 90 and axially slidable inside the hinge case 92. The reference 98*c* indicates a small hole through which the adjusting screw 97 is penetrated. The rotating shaft 90 has a non-round fixing shaft portion 90*b* on which a large-diameter portion 90*c* of which the outside diameter is nearly same as the inside diameter of the hinge case 92 and on which there is formed a circumferential groove 90*d* on which a rubber ring 99 of a rotation control means 105 is fitted. The rubber ring 99 has a plurality of circumferential grooves 99*a*, and a viscous oil (not shown) is charged between the outer surface of the rubber ring 99 and the inner wall of the hinge case 92. Note that the rubber ring 99 is not limited in material to a rubber but it may be a well-known one made of any other material such as a synthetic resin.

As best shown in FIGS. 21 and 22, the hinge case 92 has a plurality of projections 100*a* formed therein and at one end thereof, and the partition wall 94 has formed therein a plurality of engagement holes 94*b*. The plurality of projections 100*a* is inserted in the plurality of engagement holes 94*b*. The hinge device E further comprises a stationary cam 100 and a rotatable sliding cam 101. The stationary cam 100 has formed axially in the central portion thereof a circular hole 100*b* through which the non-round small-diameter portion of the rotating shaft 90 is rotatably penetrated. The stationary cam 100 has a non-circular hole 101*a* formed axially in the central portion thereof, and a cam portion 100*e* consists of crests 100*c* and troughs 100*d*. With the non-round small-diameter portion 90*a* of the rotating shaft 90 engaged in the non-circular hole 101*a*, the rotatable sliding cam 101 is disposed opposite the stationary cam 100 to be rotatable with the rotating shaft 90 and slidable axially of the rotating shaft 90. The rotatable sliding cam 101 has a cam portion 101*d* consisting of crests 101*b* and toughs 101*c*. The cam portion 101*d* of the rotatable sliding cam 101 is opposite to the cam portion 100*e* of the stationary cam 100. An elastic means 102 formed from a compression spring, for example, is wound over the non-round small-diameter portion 90*a* of the rotating shaft 90 and the spring holder 98 and between the rotatable sliding cam 101 and flange 98*a* of the spring holder 98. The elastic means 102 urges the rotatable sliding cam 101 to slide towards the stationary cam 100.

Figure 23:
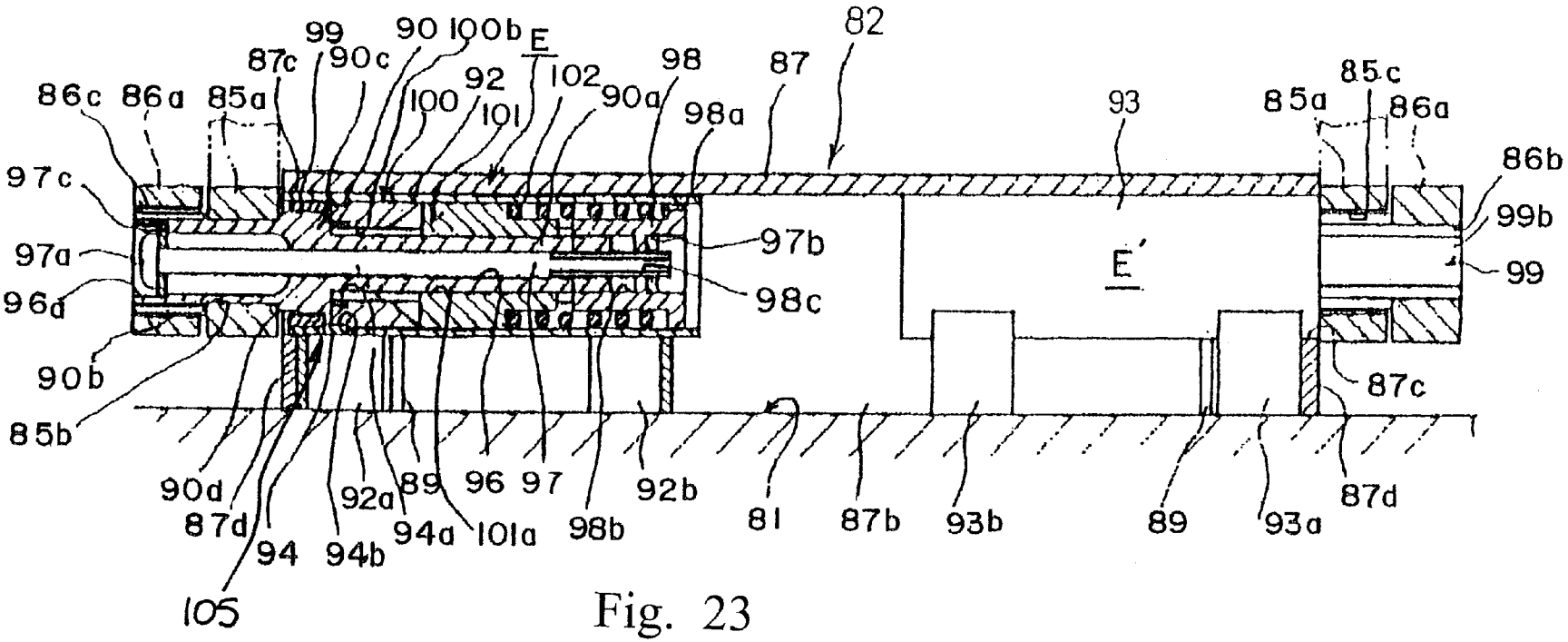
FIG. 23 is a partially cross-sectional front view of the hinge device of the present invention, installed to the seat and seat lid of a toilet bowl.
Figure 24:
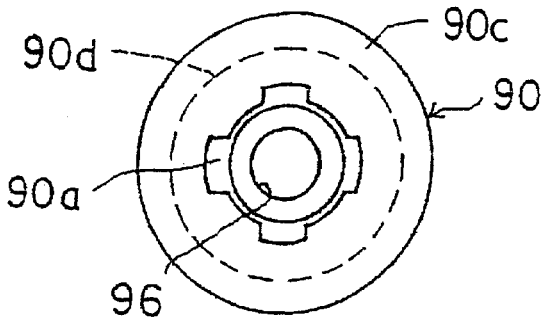
FIG. 24 is a right side elevation of the rotating shaft of the hinge device shown in FIGS. 1 to 23.
Figure 25:
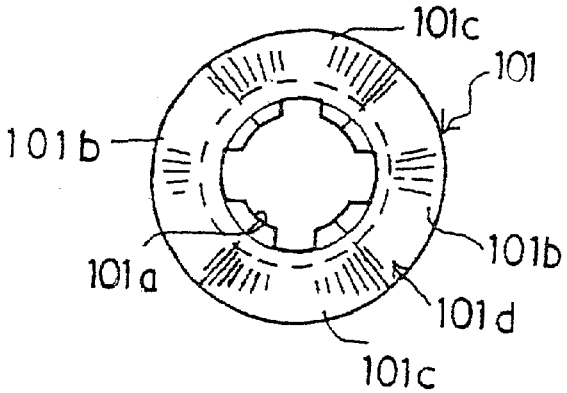
FIG. 25 is a left side elevation of the rotatable sliding cam included in the present invention.
Figure 26:
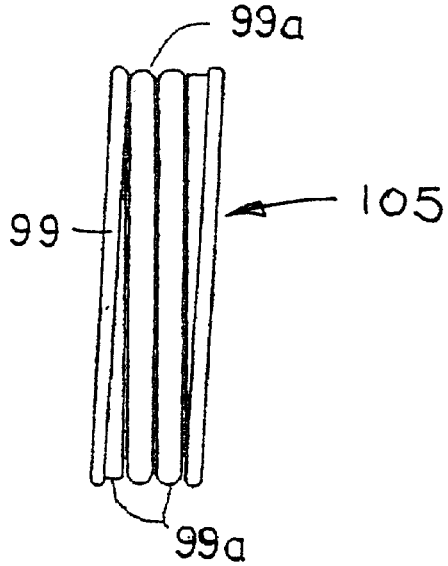
FIG. 26 is a front view, enlarged in scale, of the damper ring included in the present invention.
Figure 27:
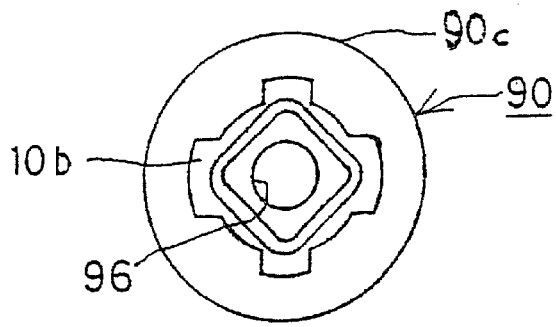
FIG. 27 is a left side elevation of the rotating shaft included in the hinge device shown in FIGS. 1 to 6.
Figure 28:
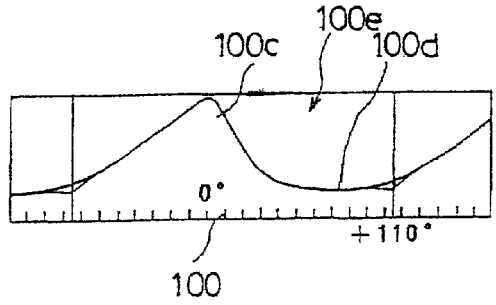
FIG. 28 is a development of the cam portion of the fixing cam included in the present invention.
Figure 29:
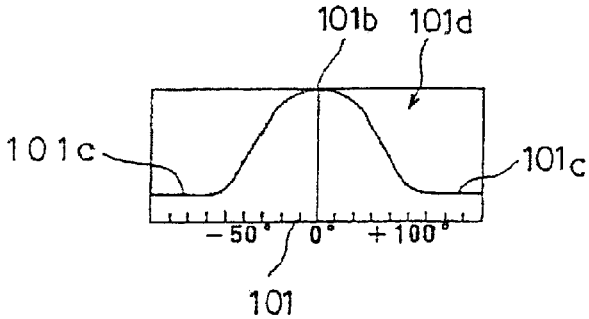
FIG. 29 is a development of the cam portion of the rotatable sliding cam member included in the present invention.

As shown in FIGS. 22 and 23, the fixture 85*a* for the seat 85 has formed therein a non-circular fixing hole 85*b* in which the non-round fixing shaft portion 90*b* of the rotating shaft 90 of the hinge device E for the seat is engaged, so that when the seat 85 is operated, it is rotated along with the rotating shaft 90. The fixture 86*a* for the seat lid 86 has also formed therein a circular fixing hole 86*c* in which the fixing shaft portion 90*b* of the rotating shaft 90 is inserted. When the seat lid 86 is operated, it is rotated about the rotating shaft 90, not rotated with the latter.

On the other hand, the rotating shaft 91 included in the right hinge device E' for the seat lid 86 has a non-round fixing shaft portion 91*b*. The fixture 86*a* for the seat lid 86 has a non-circular fixing hole 86*b* formed therein. The non-round fixing shaft portion 91*b* of the rotating shaft 91 is inserted in the non-circuit fixing hold 86*b* while the fixture 85*a* for the seat 85 is born in the circular fixing hole 85*c*. Thus, as the seat lid 86 is operated, the rotating shaft 91 of the right hinge device E' is rotated correspondingly, but not when the seat 86 is operated.

In this embodiment in which the fixtures 85*a* and 86*a* are formed integrally with the seat 85 and the sea lid 86, respectively, with the non-circular fixing holes 8*b* and 86*b* and circular fixing holes 85*c* and 86*c* formed in the fixtures 85*a* and 86*a*, respectively, aligned beforehand with the insertion holes 87*c* formed at the opposite ends of the case body 87 of the holder 82, any one of the hinge devices E and E' is first inserted into the case body 87 from the opening 87*b*. Concerning the hinge case E, it is inserted into the case body 87 of the holder 82 from the bottom opening 87*b* and displaced axially until the rotating shaft 90 is projected out of the insertion hole 87*c* at the end of the case body 87. While the leg 92*a* is being engaged into the engagement piece 89, the rotating shaft 90 is inserted into one non-circular fixing hole 85*b* and circular fixing hole 86*c* in the fixtures 85*a* and 86*a*, respectively, of the seat 85 and the seat lid 86. Next, concerning the hinge device E', it is inserted into the case body 87 from the bottom opening and displaced axially until the rotating shaft 91 is projected out of the insertion hole 87*c* in the other end of the case body 87. While the leg 93*a* is being engaged into the engagement piece 89, the rotating shaft 91 is inserted into the other circular fixing hole 85*c* and non-circular fixing hole 86*b* in the fixtures 85*a* and 86*a*, respectively, of the seat 85 and the seat lid 86.

The holder 82 is positioned in place on the toilet bowl body 81, and the fixtures 88 are secured to the toilet bowl body 81 with fixing bolts 103.

After that, when the seat 85 is operated, the rotating shaft 90 is rotated correspondingly. When the seat 85 is in the closed position, the crests 100*c* of the cam portion 100*e* of the stationary cam 100 are pressed to the crests 101*b* of the cam portion 101*d* of the rotatable sliding cam 101 under the elasticity of the elastic means 102. When the seat 85 is opened, the crests 101*b* of the rotatable sliding cam 101 fall into the troughs 100*d* of the stationary cam 100 while the rotatable sliding cam 101 is being rotated with the rotating shaft 90. When the crests 101*b* fall fully into the troughs 100*d*, the seat 85 is opened to a maximum angular position of 110 deg. On the contrary, when the seat 85 is closed, the crests 101*b* of the cam portion 101*d* will move from the troughs 100*d* to the crests 100*c* of the cam portion 100*e* against the elasticity of the elastic means 102, so the seat 85 will not fall abruptly but it will be closed gently. The rubber ring 99 is provided to damp the rotation of the rotating shaft 90.

Owing to the circumference grooves 99*a* on the rubber ring 99, the viscous oil will spread uniformly over the outer surface of the rubber ring 99 and it will not run short.

To adjust the torque of the rotating shaft 90 in the hinge device E, a screwdriver is introduced from the end of the fixing shaft portion 90*b* of the rotating 90 to turn the adjusting screw 97 clockwise or counterclockwise. In this case, the hinge device E may not be removed from the holder 83 for this adjustment. As the adjusting screw 97 is turned, the spring holder 98 moves to the right or left and thus the effective length of the elastic means 102 is increased or decreased so that the elasticity of the elastic means 102 can be adjusted. Thus, the torque of the rotating shaft 90 can be freely adjusted also after the hinge device E has been installed. This adjustment is also true for the left hinge device E'.

Further, a sixth embodiment of the hinge device according to the present invention will be described below with reference to FIGS. 31 to 40. As shown, this embodiment includes a pair of hinge devices F and F'. Different from the aforementioned embodiments of the present invention, however, the hinge devices F and F' are not to be installed in a dedicated holder which is to be fixed to the body of a toilet bowl, but they are to be installed independently on the body of a toilet bowl 111. The hinge devices F and F' comprise hinge cases 120 and 121, respectively, and fixtures 116 and 117 projected from the hinge cases 120 and 121, respectively, as shown. Of the pair of hinge devices F and F', the left one F is for use with a seat of the toilet bowl 111 while the right one F' is for use with a seat lid. The left and right hinge devices F and F' are of a same basic same internal structure except that they are different in shape of cam member and elasticity of elastic means. Therefore, only the right-side hinge device F' for the seat will be described below.

The hinge case 120 of the hinge device F' has a partition wall 123 formed near the right end thereof. The partition wall 123 has formed therein a bearing hole 123*a* through which a rotating shaft 124 is penetrated axially inside the hinge case 120 to be rotatable. The rotating shaft 124 has formed therein a through-hole 124*d* extending longitudinally in the central portion thereof. An adjusting screw 127 is installed axially through the through-hole 124*d*. The adjusting screw 127 is projected at either end thereof from either end of the rotating shaft 124. The screw 127 has a head 127*a* is penetrated through and engaged in a spring holder 126. The rotating shaft 124 consists of a large-diameter portion 124*c* formed at one end thereof and having an outside diameter generally same as the inner diameter of the hinge case 120, and a non-round fixing shaft portion 124*b* projected out of the hinge case 120. The large-diameter portion 124*c* has formed thereon a circumferential groove 124*e* in which an O-ring 125 is fitted. The adjusting screw 127 is projected at the other end thereof out of the fixing shaft portion 124*b* of the rotating shaft 124 and formed to be a knob fixing portion 127*c* on which a but 127*b* is screwed. A knob 119 is secured to the knob fixing portion 127*c*.The spring holder 126 has formed at one end thereof a flange 126*a* which is in contact with the inner wall of the hinge case 120, and at the other end thereof a non-circular engagement hole 126*c* in which a non-round small-diameter portion 124*a* of the rotating shaft 124 is engaged, so that the spring holder 126 is rotatable with the rotating shaft 124 and axially movable inside the hinge case 120. The flange 126*a* of the spring holder 126 has formed thereon a circumferential groove 126*d* in which a rubber ring 132 is fitted. The rubber ring 132 has formed thereon a circumferential groove 132*a* in which a viscous oil (not shown) is applied. The reference 126*b* indicates a circular small hole through which the adjusting screw 127 is penetrated and which concentrically communicates with the non-circular engagement hole 126*c*.

A stationary cam 128 is provided inside the hinge case 120. The stationary cam 128 has a plurality of projections 128*a* formed on one end thereof. The partition wall 123 has also a plurality of engagement holes 123*b* formed therein. The plurality of projections 128*a* is engaged in the plurality of engagement holes 123*b*. The stationary cam 128 has a circular insertion hole 128*b* formed longitudinally in the central portion therein. The rotating shaft 124 has also a non-round small-diameter portion 124*a* which is inserted in the circular insertion hole 128*b*. The stationary cam 128 has a cam portion 128*e* consisting of crests 128*c* and troughs 128*d*. There is provided opposite the cam portion 128*e* of the stationary cam 128 a rotatable sliding cam 129 having a non-circular hole 129*a* formed axially in the central portion thereof. The non-round small-diameter portion 124*a* of the rotating shaft 124 is engaged in the non-circular hole 129*a* of the rotatable sliding cam 129 so that the latter is rotatable with the rotating shaft 124 and slidable axially of the rotating shaft 129. The rotatable sliding cam 129 has provided at a portion thereof opposite to the cam portion 128*a* of the stationary cam 128 a cam portion 129*d* consisting of crests 129*b* and troughs 129*c*. An elastic means 130 formed from a compression spring is wound on other than the non-round small-diameter portion 124*a* and flange 126*a* of the spring holder 126 and between the rotatable sliding cam 129 and flange 126*a* of the spring holder 126. The elastic means 130 forces the rotatable sliding cam 129 to slide towards the stationary cam 128.

Figure 30:
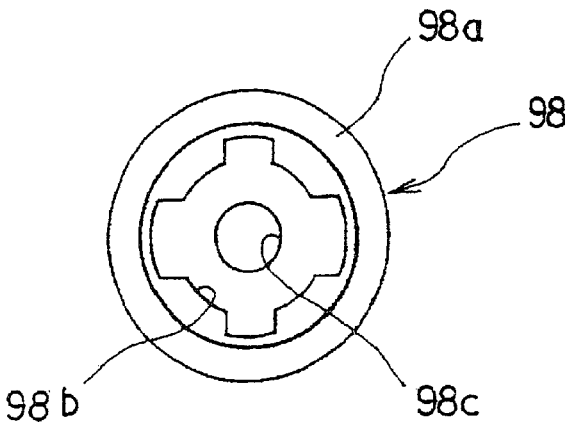
FIG. 30 is a left elevation of the spring holder included in the present invention.
Figure 31:
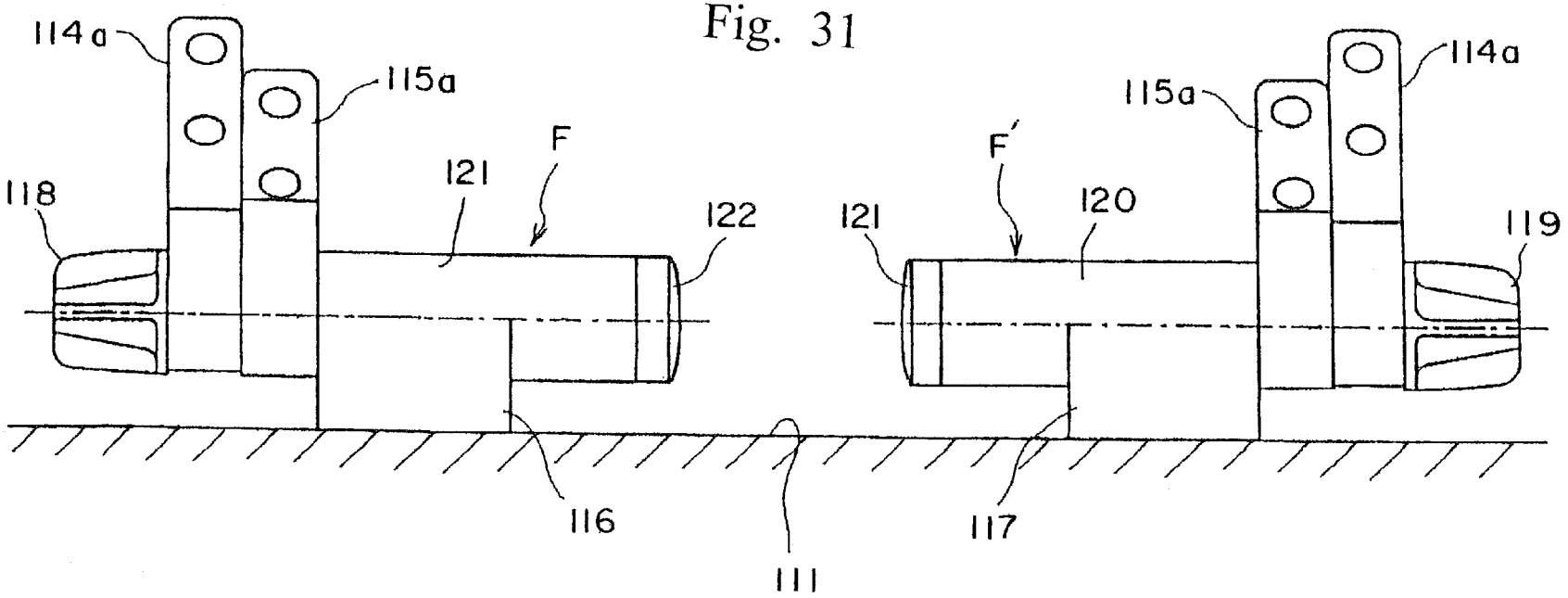
FIG. 31 is a front view of a further embodiment of the hinge device according to the present invention for use with the seat and seat lid of a toilet bowl.
Figure 32:
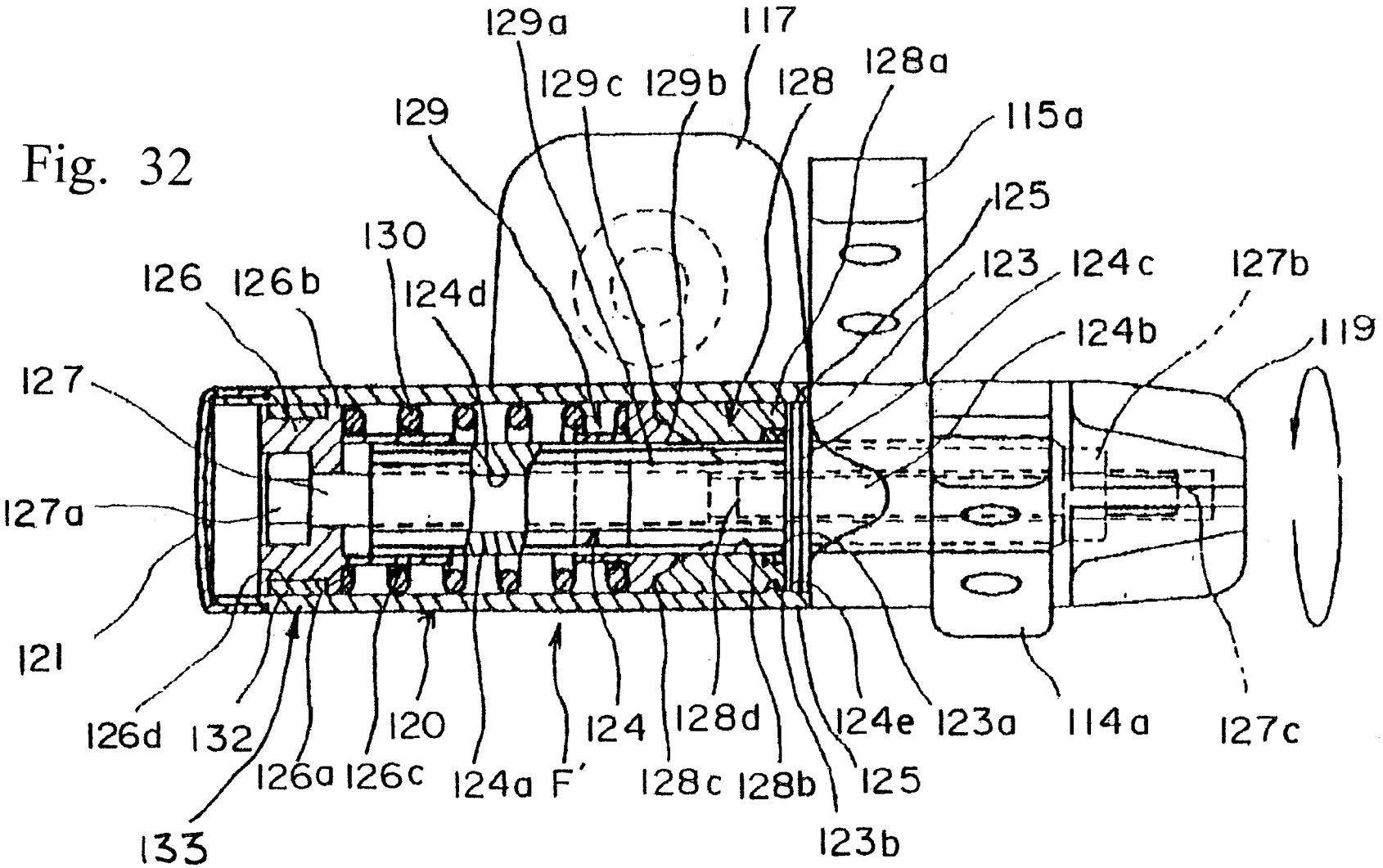
FIG. 32 is a partially sectional plan view of the right half of the hinge device in FIG. 31.
Figure 33:
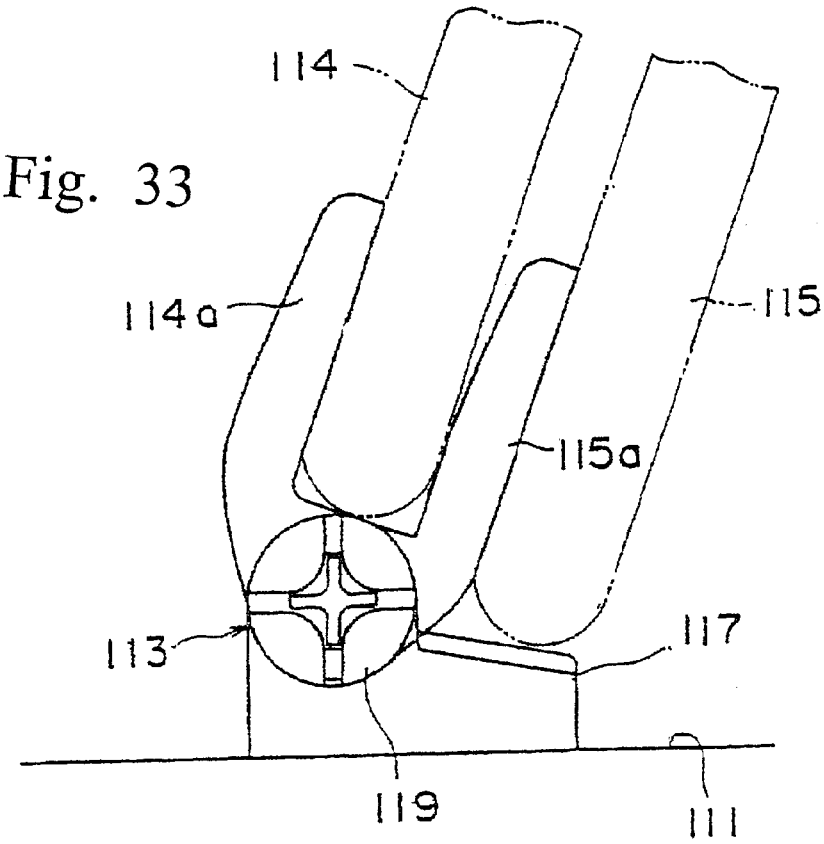
FIG. 33 is a right side elevation of the right half of the hinge device in FIG. 31, corresponding to FIG. 15.
Figure 35:
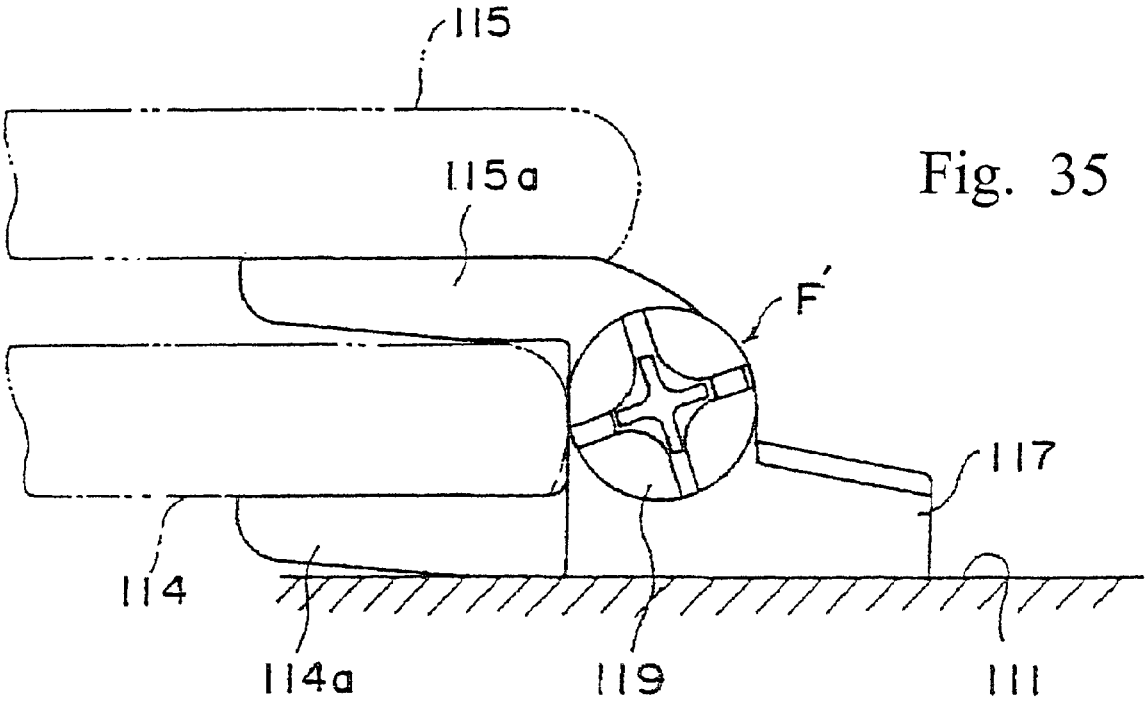
FIG. 35 is a right side elevation of the hinge device in FIG. 34.
Figure 34:
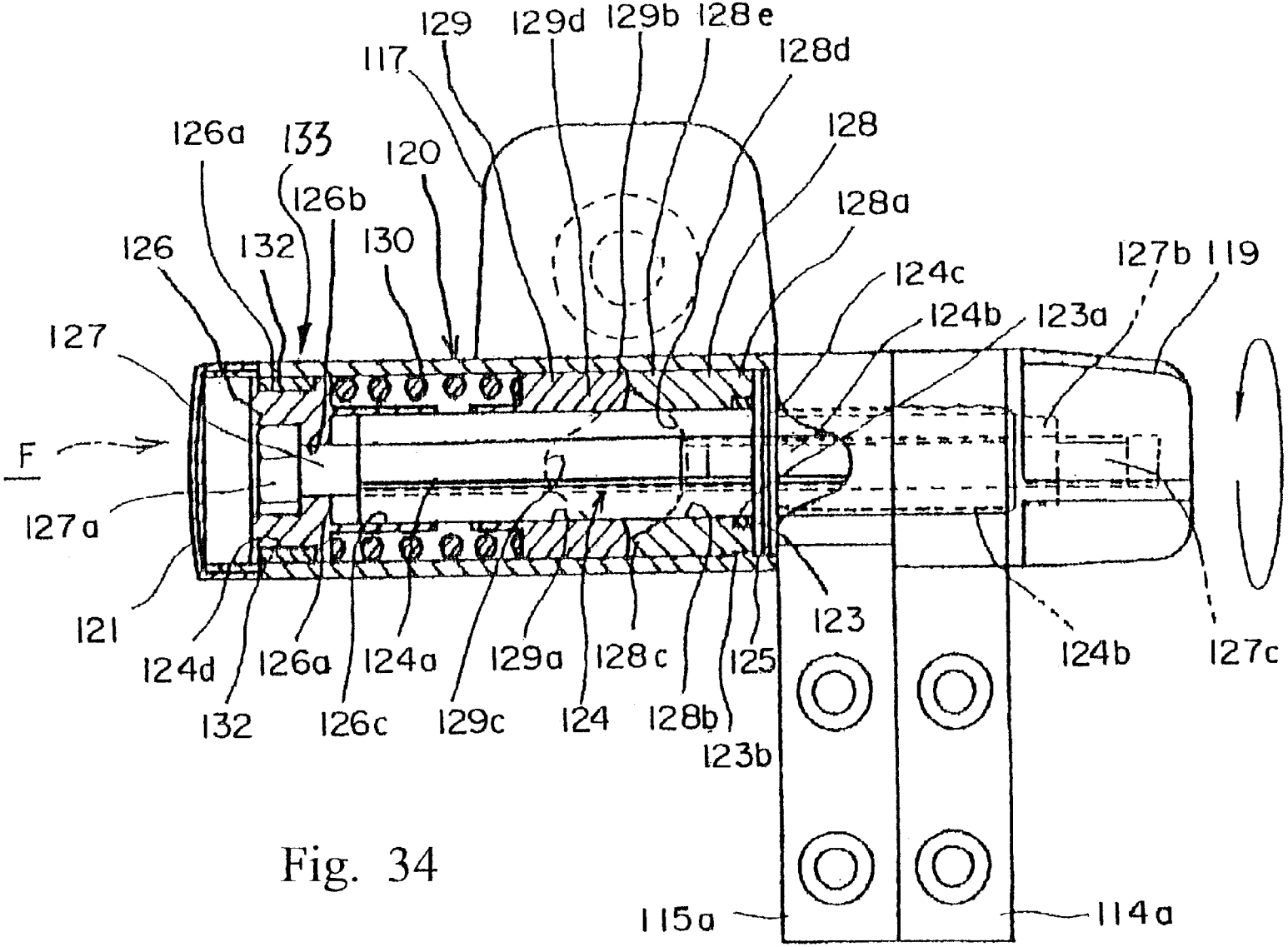
FIG. 34 is a partially sectional plan view of the hinge device in FIG. 32, explaining the function of the hinge device.
Figure 3:
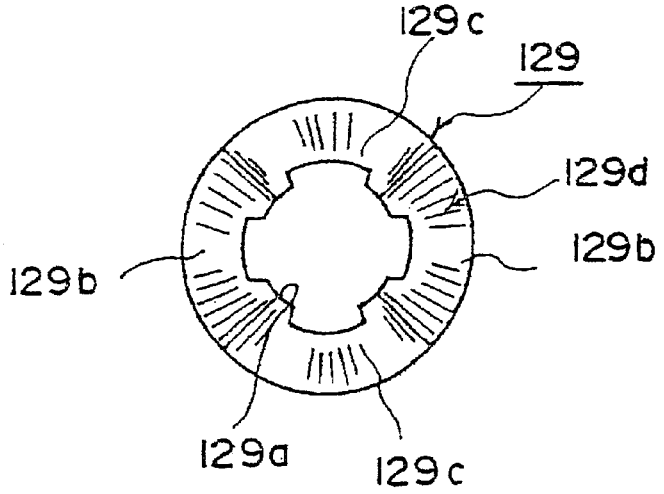
Figure 3:
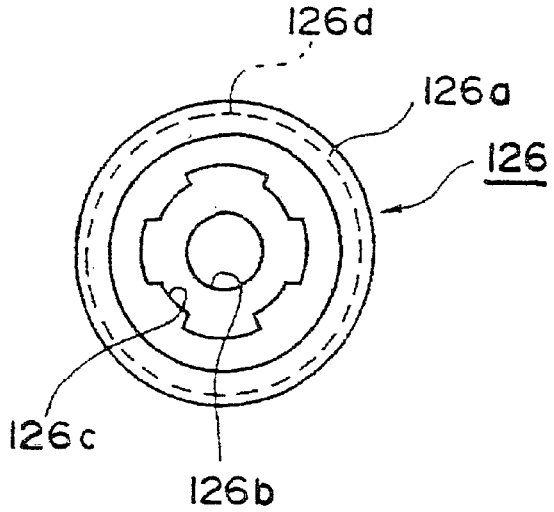
Figure 3:
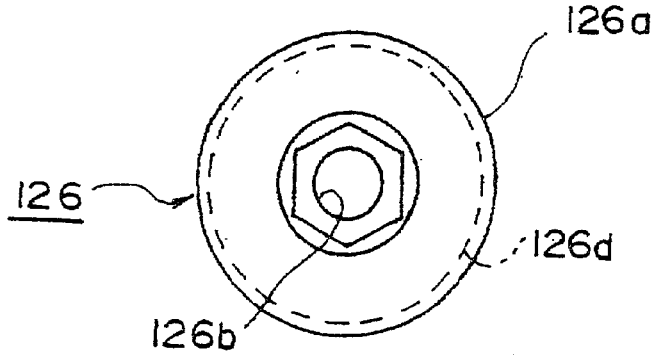
Figure 39:
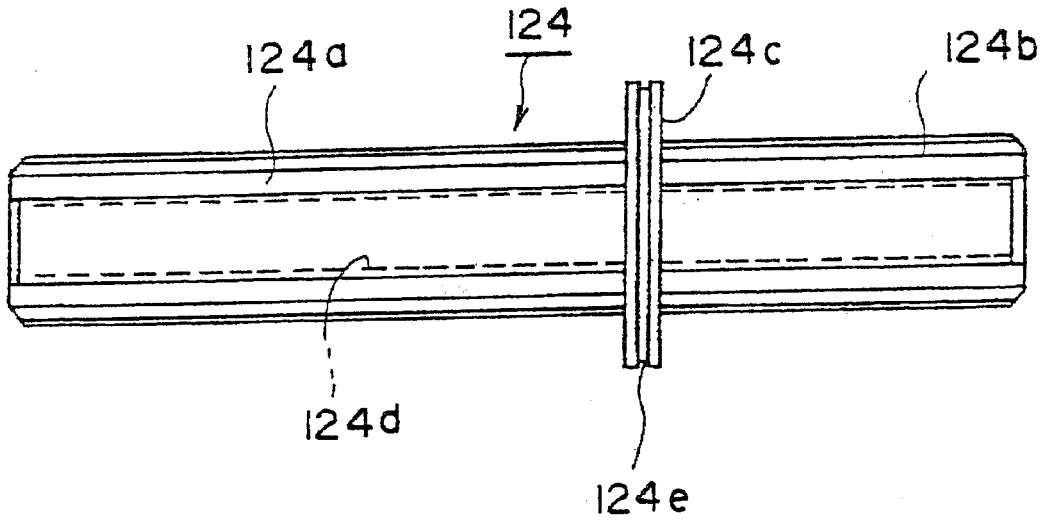
FIG. 39 is a plan view of the rotating shaft shown in FIGS. 32 and 34.
Figure 40:
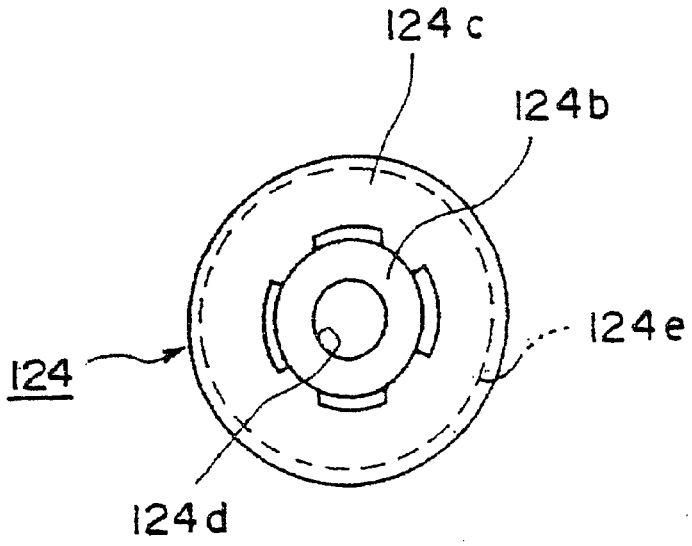
FIG. 40 is a right side elevation of the rotating shaft in FIG. 39.

As shown in FIGS. 30, 31 and 33, the rotating shaft 124 of the left hinge device F' for the seat is engaged at the non-round fixing shaft portion 124*b* thereof engaged in a non-circular fixing hole (not shown) formed in a fixture 114*a* of a seat lid 114. Thus, as the seat lid 114 is operated, the rotating shaft 124 is rotated correspondingly. The fixing shaft portion 124*b* of the rotating shaft 124 is inserted in a circular fixing hole (not shown) formed in a fixture 115*a* of a set 115. Thus when the seat 115 is operated, it is rotated about the rotating shaft 124, not rotated with the latter.

On the other hand, the rotating shaft of the left hinge device F for the seat 115 has a no-round fixing shaft portion there of engaged in a non-circular fixing hole (not shown) formed in the fixture 115*a* for the seat 115 and born in a circular fixing hole (not shown) formed in the fixture 114*a* for the seat lid 114. Therefore, the rotating shaft of the left hinge device F is rotated as the seat 115 is operated but not when the seat lid 114 is operated.

The right hinge device F' will be described again. When the seat lid 114 is operated, the rotating shaft 124 is rotated correspondingly. When the seat lid 114 is in the closed position, the crests 128*c* of the cam portion 128*e* of the stationary cam 128 are pressed to the crests 129*b* of the cam portion 129*d* of the rotatable sliding cam 129 under the elasticity of the elastic means 130. However, as the seat lid 114 is opened, the rotatable sliding cam 129 is rotated along with the rotating shaft 124 while the crests 129*b* of the cam 129 fall into the troughs 128*d* of the stationary cam 128. When the crests 129*b* full fall into the troughs 128*d*, the seat lid 114 is opened to a maximum angular position of 110 deg.

On the contrary, when the seat lid 114 is closed, the crests 129*b* of the cam portion 129*d* move from the troughs 128*d* of the cam portion 128*e* to the crests 128*c* against the pressure of the elastic means 130. Thus the seat lid 114 fill not be closed abruptly but it will be closed gently. The rubber ring 132 of a rotation control means 133 is provided to damp the rotation of the rotating shaft 124, namely, the operation of the seat lid 114.

The circumferential groove 132*a* on the rubber ring 132 spreads the viscous oil uniformly over the outer surface of the rubber ring 132, and thus the viscous oil will not run short.

To adjust the torque of the rotating shaft 124, the know 119 is turned clockwise or counterclockwise. The spring holder 126 will move rightward or leftward and thus the effective length of the elastic means 130 is increased or decreased, thereby permitting to adjust the elasticity of the elastic means 130. Thus, the pressure of the rotatable sliding cam 129 to the stationary cam 128 can be changed to freely adjust the torque of the operating shaft 124 even after the hinge device F' is installed to the toilet bowl body 111. By turning the knob 122 of the left hinge device F clockwise or counterclockwise, the torque of the rotating shaft can be adjusted in the same manner.

What is claimed is:

1. A hinge device for use to support a seat and seat lid of a toilet bowl which are openably and closably on a body of the toilet bowl, the device comprising:

a cylindrical hinge case having an axis and adapted to be fixed to the body of a toilet bowl;

a rotating shaft having a large-diameter portion and a small-diameter portion and partially inserted into the hinge case such that the rotating shaft is rotatable about the axis of the hinge case;

a stationary cam provided inside the hinge case in a state in which rotation of the stationary cam is restricted, the small-diameter portion of the rotating shaft penetrating a central portion of the stationary cam;

a rotatable sliding cam provided inside the hinge case opposite the stationary cam, the rotatable sliding cam being slidable axially and rotatable along with the small-diameter portion of the rotating shaft, the small-diameter portion of the rotating shaft penetrating the central portion of the rotatable sliding cam;

elastic means having an elasticity and provided inside the hinge case and adapted to press one of the rotatable sliding cam and the stationary cam toward the other of the rotatable sliding cam and the stationary cam; and elasticity adjusting means for adjusting the elasticity of the elastic means, the elasticity adjusting means comprising the stationary cam which is slidably disposed in an axially movable manner within the hinge case, and an adjustment cap which abuts a portion of the stationary cam and is screwed into the hinge case in an axially movable manner.

* * * * *